US008866568B2

(12) United States Patent
Fukunaga

(10) Patent No.: US 8,866,568 B2
(45) Date of Patent: Oct. 21, 2014

(54) SIGNAL TRANSMISSION DEVICE, FILTER, AND INTER-SUBSTRATE COMMUNICATION DEVICE

(75) Inventor: Tatsuya Fukunaga, Tokyo (JP)

(73) Assignee: TDK Corporation, Tokyo (JP)

( * ) Notice: Subject to any disclaimer, the term of this patent is extended or adjusted under 35 U.S.C. 154(b) by 494 days.

(21) Appl. No.: 13/221,075

(22) Filed: Aug. 30, 2011

(65) Prior Publication Data

US 2012/0062343 A1 Mar. 15, 2012

(30) Foreign Application Priority Data

Aug. 31, 2010 (JP) ..... 2010-194556

(51) Int. Cl.
*H01P 3/08* (2006.01)
*H01P 1/203* (2006.01)

(52) U.S. Cl.
CPC ..... *H01P 1/20345* (2013.01)
USPC ..... 333/204; 333/175; 333/185

(58) Field of Classification Search
USPC ..... 333/175, 184, 185, 204
See application file for complete search history.

(56) References Cited

U.S. PATENT DOCUMENTS 5,412,358 A * 5/1995 Hirai et al. ..... 333/204
5,892,415 A * 4/1999 Okamura ..... 333/175

FOREIGN PATENT DOCUMENTS

| | | |
|---|---|---|
| JP | A-2001-523412 | 11/2001 |
| JP | A-2002-185206 | 6/2002 |
| JP | A-2008-067012 | 3/2008 |
| JP | A-2008-271606 | 11/2008 |
| JP | A-2010-206319 | 9/2010 |
| JP | A-2010-206320 | 9/2010 |
| WO | WO 98/48473 A1 | 10/1998 |

* cited by examiner

*Primary Examiner* — Robert Pascal
*Assistant Examiner* — Kimberly Glenn
(74) *Attorney, Agent, or Firm* — Oliff PLC

(57) ABSTRACT

A signal transmission device includes: a first substrate and a second substrate disposed to oppose each other in a first direction; a first resonator including a plurality of first quarter wavelength resonators provided in a first region of the first substrate, and interdigitally coupled to one another in the first direction, and a single or the plurality of second quarter wavelength resonators provided in a region of the second substrate corresponding to the first region and interdigitally coupled to one another in the first direction; and a second resonator electromagnetically coupled to the first resonator, and performing a signal transmission between the second resonator and the first resonator. The first and the second quarter wavelength resonators located at positions nearest to one another in the first resonator, respectively have open ends which are disposed to oppose one another, and respectively have short-circuit ends which are disposed to oppose one another.

7 Claims, 26 Drawing Sheets
(2 of 26 Drawing Sheet(s) Filed in Color)

SUBSTRATE SIZE: 2mm SQUARE
RELATIVE DIELECTRIC CONSTANT OF SUBSTRATE: 3.85
SIZE OF ELECTRODE(1/4 WAVELENGTH RESONATOR): 1.5mm(LENGTH)×0.2mm(WIDTH)

SUBSTRATE SIZE: 2mm SQUARE
RELATIVE DIELECTRIC CONSTANT OF SUBSTRATE: 3.85
SIZE OF ELECTRODE (1/4 WAVELENGTH RESONATOR): 1.5mm (LENGTH) × 0.2mm (WIDTH)

SIGNAL TRANSMISSION DEVICE, FILTER, AND INTER-SUBSTRATE COMMUNICATION DEVICE

BACKGROUND

This disclosure relates to a signal transmission device, a filter, and an inter-substrate communication device, each performing a signal transmission by using a plurality of substrates each of which is formed with a resonator.

A signal transmission device has been known in which a plurality of substrates, each of which is formed with a resonator, are used to perform a signal transmission. For example, Japanese Unexamined Patent Application Publication No. 2008-67012 discloses a high-frequency signal transmission device in which a resonator is structured in each of substrates which are different from each other. Those resonators are electromagnetically coupled to each other to configure two stages of filters, so as to allow a signal transmission to be established.

SUMMARY

The inventor/the inventors has/have found that when a configuration is employed where resonators, formed respectively on substrates which are different from each other, are electromagnetically coupled as described above, an electric field and a magnetic field are generated between the substrates. The currently-available configuration has drawbacks, in that a variation in thickness of a layer of air present between the substrates causes a large change in factors such as a coupling coefficient and a resonance frequency between the resonators, and thus factors such as a center frequency and a bandwidth configuring a filter are varied significantly.

It is desirable to provide a signal transmission device, a filter, and an inter-substrate communication device, capable of suppressing a variation in factors such as a pass frequency and a pass band caused by a variation in a distance between substrates, and thereby performing a stable operation.

A signal transmission device according to an embodiment of the technology includes: a first substrate and a second substrate which are disposed to oppose each other in a first direction with a spacing in between; a first resonator including a plurality of first quarter wavelength resonators and a single or a plurality of second quarter wavelength resonators, the plurality of first quarter wavelength resonators being provided in a first region of the first substrate, and interdigitally coupled to one another in the first direction, the single or the plurality of second quarter wavelength resonators being provided in a region of the second substrate corresponding to the first region, and the plurality of second quarter wavelength resonators being interdigitally coupled to one another in the first direction; and a second resonator electromagnetically coupled to the first resonator, and performing a signal transmission between the second resonator and the first resonator. The first quarter wavelength resonator and the second quarter wavelength resonator, which are located at positions nearest to one another in the first resonator, respectively have open ends which are disposed to oppose one another, and respectively have short-circuit ends which are disposed to oppose one another.

A filter according to an embodiment of the technology includes: a first substrate and a second substrate which are disposed to oppose each other in a first direction with a spacing in between; a first resonator including a plurality of first quarter wavelength resonators and a single or a plurality of second quarter wavelength resonators, the plurality of first quarter wavelength resonators being provided in a first region of the first substrate, and interdigitally coupled to one another in the first direction, the single or the plurality of second quarter wavelength resonators being provided in a region of the second substrate corresponding to the first region, and the plurality of second quarter wavelength resonators being interdigitally coupled to one another in the first direction; and a second resonator electromagnetically coupled to the first resonator, and performing a signal transmission between the second resonator and the first resonator. The first quarter wavelength resonator and the second quarter wavelength resonator, which are located at positions nearest to one another in the first resonator, respectively have open ends which are disposed to oppose one another, and respectively have short-circuit ends which are disposed to oppose one another.

Advantageously, in the signal transmission device and the filter, the second resonator includes a plurality of third quarter wavelength resonators and a single or a plurality of fourth quarter wavelength resonators, the plurality of third quarter wavelength resonators being provided in a second region of the first substrate, and interdigitally coupled to one another in the first direction, the single or the plurality of fourth quarter wavelength resonators being provided in a region of the second substrate corresponding to the second region, and the plurality of fourth quarter wavelength resonators being interdigitally coupled to one another in the first direction, and the third quarter wavelength resonator and the fourth quarter wavelength resonator, which are located at positions nearest to one another in the second resonator, respectively have open ends which are disposed to oppose one another, and respectively have short-circuit ends which are disposed to oppose one another.

An inter-substrate communication device according to an embodiment of the technology includes: a first substrate and a second substrate which are disposed to oppose each other in a first direction with a spacing in between; a first resonator including a plurality of first quarter wavelength resonators and a single or a plurality of second quarter wavelength resonators, the plurality of first quarter wavelength resonators being provided in a first region of the first substrate, and interdigitally coupled to one another in the first direction, the single or the plurality of second quarter wavelength resonators being provided in a region of the second substrate corresponding to the first region, and the plurality of second quarter wavelength resonators being interdigitally coupled to one another in the first direction; the second resonator including a plurality of third quarter wavelength resonators and a single or a plurality of fourth quarter wavelength resonators, the plurality of third quarter wavelength resonators being provided in a second region of the first substrate, and interdigitally coupled to one another in the first direction, the single or the plurality of fourth quarter wavelength resonators being provided in a region of the second substrate corresponding to the second region, the plurality of fourth quarter wavelength resonators being interdigitally coupled to one another in the first direction, and the second resonator being electromagnetically coupled with the first resonator and performing a signal transmission between the second resonator and the first resonator; a first signal-lead electrode provided in the first substrate, the first signal-lead electrode being directly connected physically to one of the plurality of first quarter wavelength resonators, or being electromagnetically coupled to one of the plurality of first quarter wavelength resonators while providing a spacing in between; and a second signal-lead electrode provided in the second substrate, the second signal-lead electrode being directly connected physically to the single fourth quarter wavelength resonator or to one of the plurality of fourth quarter wavelength resonators, or being electromagnetically coupled to the single fourth quarter wavelength resonator or to one of the plurality of fourth quarter wavelength resonators while providing a spacing in between. The first quarter wavelength resonator and the second quarter wavelength resonator, which are located at positions nearest to one another in the first resonator, respectively have open ends which are disposed to oppose one another, and respectively have short-circuit ends which are disposed to oppose one another. The third quarter wavelength resonator and the fourth quarter wavelength resonator, which are located at positions nearest to one another in the second resonator, respectively have open ends which are disposed to oppose one another, and respectively have short-circuit ends which are disposed to oppose one another. The signal transmission is performed between the first substrate and the second substrate.

In the signal transmission device, the filter, and the inter-substrate communication device according to the embodiments of the technology, the first quarter wavelength resonator and the second quarter wavelength resonator, which are located at the positions nearest to one another between the first substrate and the second substrate, respectively have the open ends which are disposed to oppose one another, and respectively have the short-circuit ends which are disposed to oppose one another. The first quarter wavelength resonator and the second quarter wavelength resonator are thus coupled to each other through an electromagnetic coupling primarily involving a magnetic field component (a magnetic field coupling). Thereby, in the first resonator, there is hardly any electric field distribution in an element such as, but not limited to, a layer of air between the first substrate and the second substrate, making it possible to suppress a variation in a resonance frequency in the first resonator even when a variation is occurred in an inter-substrate distance of the element such as, but not limited to, the air layer between the first substrate and the second substrate. Likewise, the third quarter wavelength resonator and the fourth quarter wavelength resonator, which are located at the positions nearest to one another between the first substrate and the second substrate, respectively have the open ends which are disposed to oppose one another, and respectively have the short-circuit ends which are disposed to oppose one another. The third quarter wavelength resonator and the fourth quarter wavelength resonator are thus coupled to each other through the electromagnetic coupling primarily involving the magnetic field component (the magnetic field coupling). Thereby, in the second resonator, there is hardly any electric field distribution in an element such as, but not limited to, the air layer between the first substrate and the second substrate, making it possible to suppress a variation in a resonance frequency in the second resonator even when a variation is occurred in an inter-substrate distance of the element such as, but not limited to, the air layer between the first substrate and the second substrate. Hence, a variation in factors such as a pass frequency and a pass band caused by the variation in the inter-substrate distance is suppressed.

Advantageously, in the signal transmission device, the filter, and the inter-substrate communication device, in the first resonator, the plurality of first quarter wavelength resonators and the single or the plurality of second quarter wavelength resonators are electromagnetically coupled based on a hybrid resonance mode to allow the first resonator to structure a single coupled resonator resonating at a first resonance frequency as a whole, and, when the first and the second substrates are separated away from each other to fail to be electromagnetically coupled to one another, a resonance frequency derived from the plurality of first quarter wavelength resonators alone and a resonance frequency derived from the single or the plurality of second quarter wavelength resonators alone are each a frequency different from the first resonance frequency. In the second resonator, the plurality of third quarter wavelength resonators and the single or the plurality of fourth quarter wavelength resonators are electromagnetically coupled based on the hybrid resonance mode to allow the second resonator to structure a single coupled resonator resonating at the first resonance frequency as a whole, and, when the first and the second substrates are separated away from each other to fail to be electromagnetically coupled to one another, a resonance frequency derived from the plurality of third quarter wavelength resonators alone and a resonance frequency derived from the single or the plurality of fourth quarter wavelength resonators alone are each the frequency different from the first resonance frequency.

According to this embodiment, a frequency characteristic in the state where the first substrate and the second substrate are so separated away from each other that they are not electromagnetically coupled to each other, and a frequency characteristic in the state where the first substrate and the second substrate are electromagnetically coupled to each other, are different. Thereby, when the first substrate and the second substrate are electromagnetically coupled to each other, the signal transmission is performed based on the first resonance frequency, for example. On the other hand, when the first substrate and the second substrate are so separated away from each other that they fail to be electromagnetically coupled to each other, the signal transmission is not performed based on the first resonance frequency. Hence, it is possible to prevent a leakage of signal in the state where the first substrate and the second substrate are separated away from each other.

Advantageously, the signal transmission device and the filter each may further include: a first signal-lead electrode provided in the first substrate, the first signal-lead electrode being directly connected physically to one of the plurality of first quarter wavelength resonators, or being electromagnetically coupled to one of the plurality of first quarter wavelength resonators while providing a spacing in between; and a second signal-lead electrode provided in the second substrate, the second signal-lead electrode being directly connected physically to the single fourth quarter wavelength resonator or to one of the plurality of fourth quarter wavelength resonators, or being electromagnetically coupled to the single fourth quarter wavelength resonator or to one of the plurality of fourth quarter wavelength resonators while providing a spacing in between. Wherein, the signal transmission is performed between the first substrate and the second substrate.

Advantageously, the signal transmission device and the filter each may further include: a first signal-lead electrode provided in the second substrate, the first signal-lead electrode being directly connected physically to the single second quarter wavelength resonator or to one of the plurality of second quarter wavelength resonators, or being electromagnetically coupled to the single second quarter wavelength resonator or to one of the plurality of second quarter wavelength resonators while providing a spacing between the first signal-lead electrode and the first resonator; and a second signal-lead electrode provided in the second substrate, the second signal-lead electrode being directly connected physically to the single fourth quarter wavelength resonator or to one of the plurality of fourth quarter wavelength resonators, or being electromagnetically coupled to the single fourth quarter wavelength resonator or to one of the plurality of fourth quarter wavelength resonators while providing a spacing between the second signal-lead electrode and the second resonator. Wherein, the signal transmission is performed within the second substrate.

According to the signal transmission device, the filter, and the inter-substrate communication device of the embodiments of the technology, the quarter wavelength resonators, which are located at the positions nearest to one another between the first substrate and the second substrate, respectively have the open ends which are disposed to oppose one another, and respectively have the short-circuit ends which are disposed to oppose one another. Thus, in the first resonator and the second resonator, the electromagnetic coupling primarily involving the magnetic field component is established between the first substrate and the second substrate, and there is hardly any electric field distribution in an element such as, but not limited to, the air layer. This makes it possible to suppress the variation in the resonance frequency in the first resonator and in the second resonator even when the variation is occurred in the inter-substrate distance of the element such as, but not limited to, the air layer between the first substrate and the second substrate. Hence, it is possible to suppress the variation in factors such as the pass frequency and the pass band caused by the variation in the inter-substrate distance.

It is to be understood that both the foregoing general description and the following detailed description are exemplary, and are intended to provide further explanation of the technology as claimed.

BRIEF DESCRIPTION OF THE DRAWINGS

The patent or application file contains at least one drawing executed in color. Copies of this patent of patent application publication with color drawings(s) will be provided by the Office upon request and payment of the necessary fee. The accompanying drawings are included to provide a further understanding of the disclosure, and are incorporated in and constitute a part of this specification. The drawings illustrate embodiments and, together with the specification, serve to explain the principles of the technology.

Figure 9:
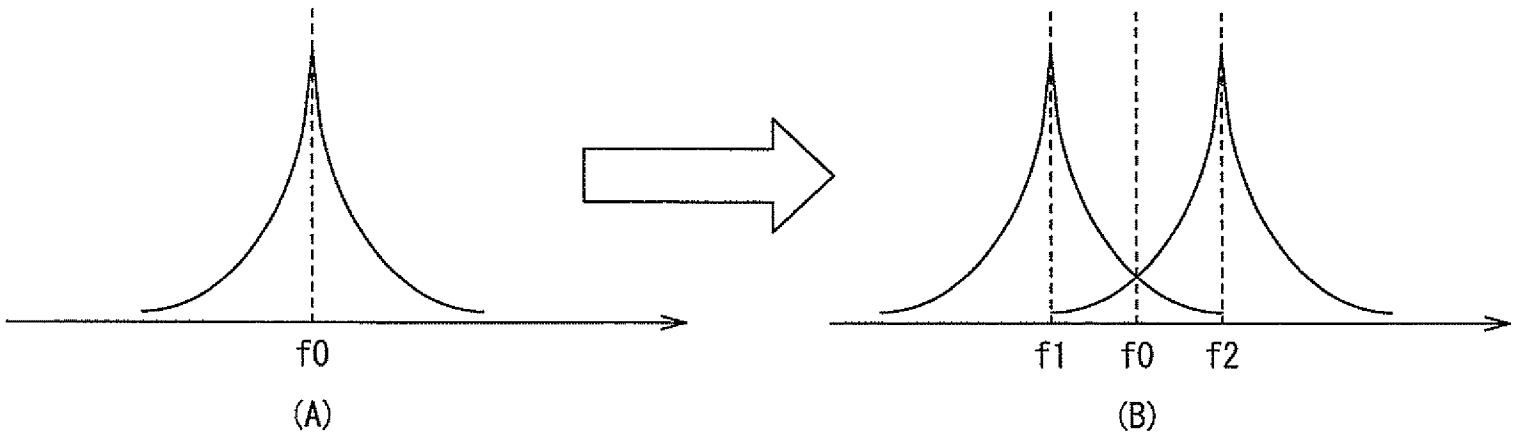

(A) of FIG. 9 describes a resonance frequency derived from a single resonator, and (B) of FIG. 9 describes resonance frequencies derived from two resonators.

Figure 8:
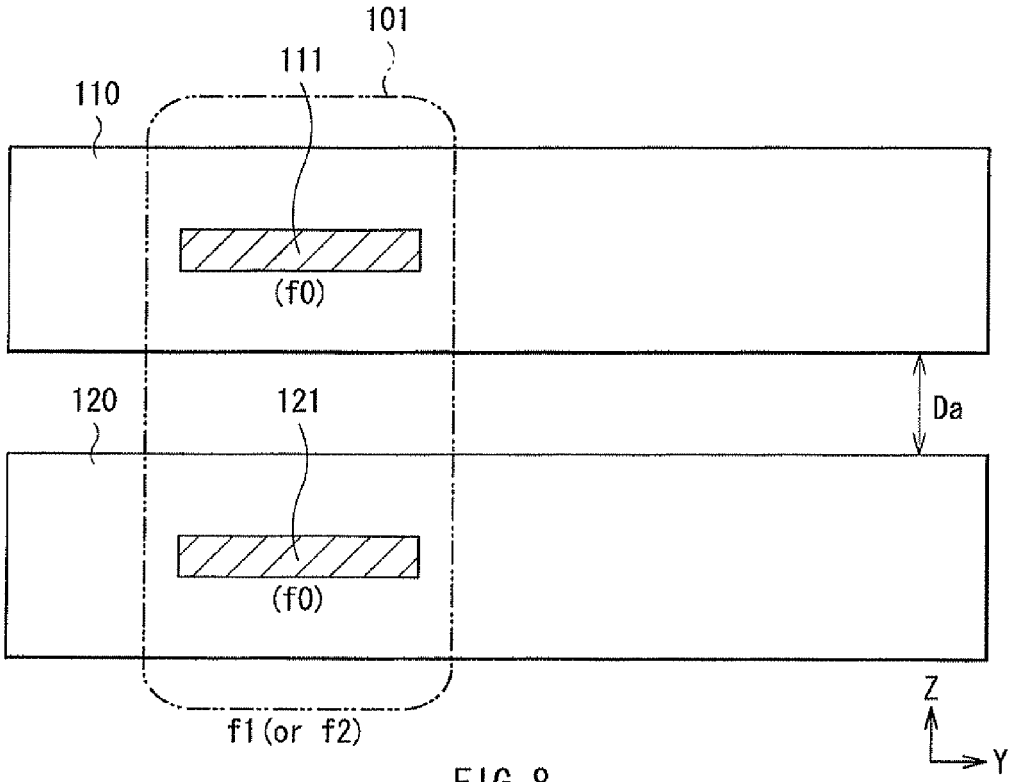
FIG. 8 is a cross-sectional view illustrating a configuration in which two substrates, each of which is the substrate illustrated in FIG. 7, are disposed to oppose each other.
Figure 10:
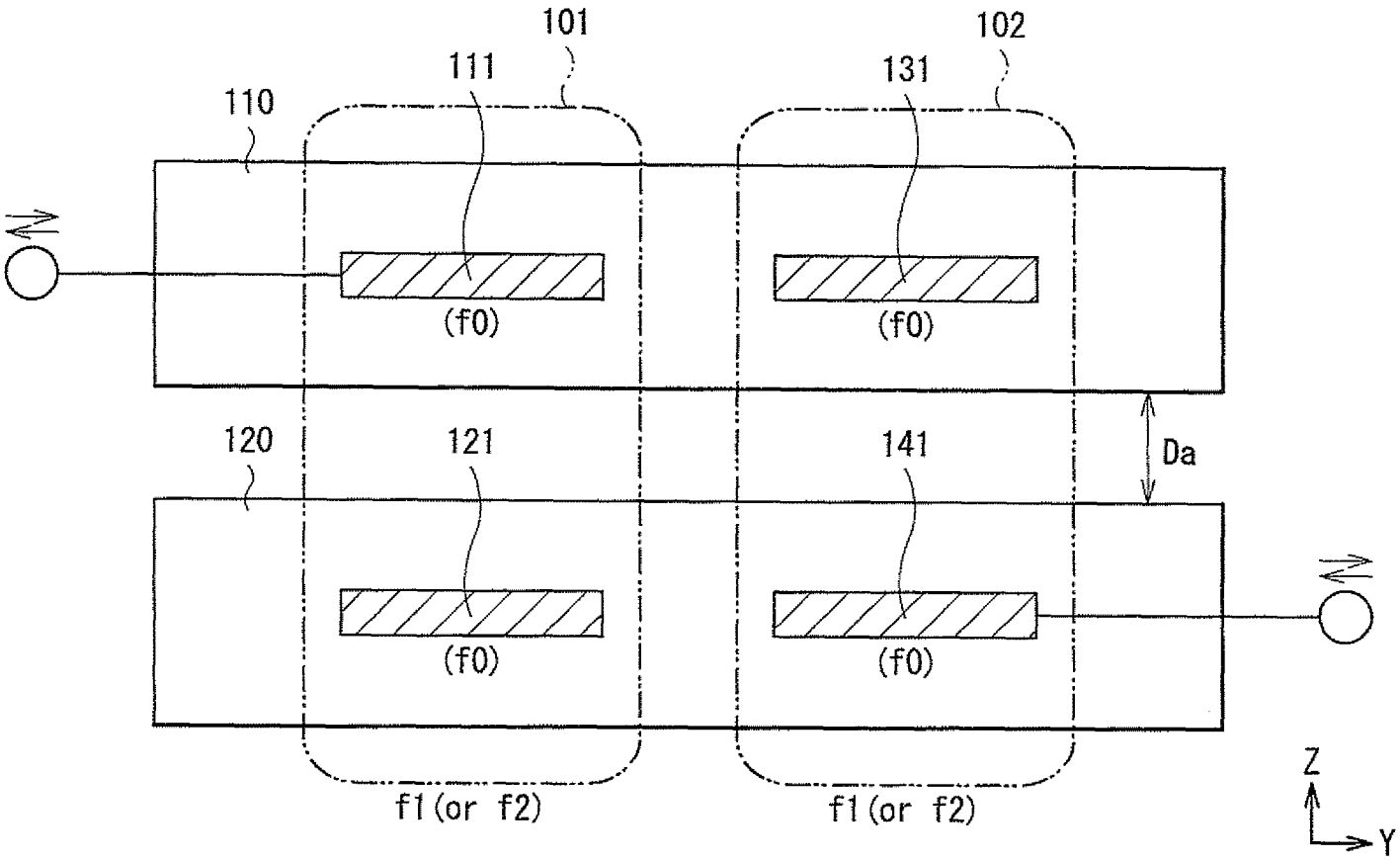

FIG. 10 is a cross-sectional view illustrating, together with a resonance frequency of each part of the substrates, a configuration of a filter formed using the resonator structure illustrated in FIG. 8 according to the comparative example.

Figure 11:
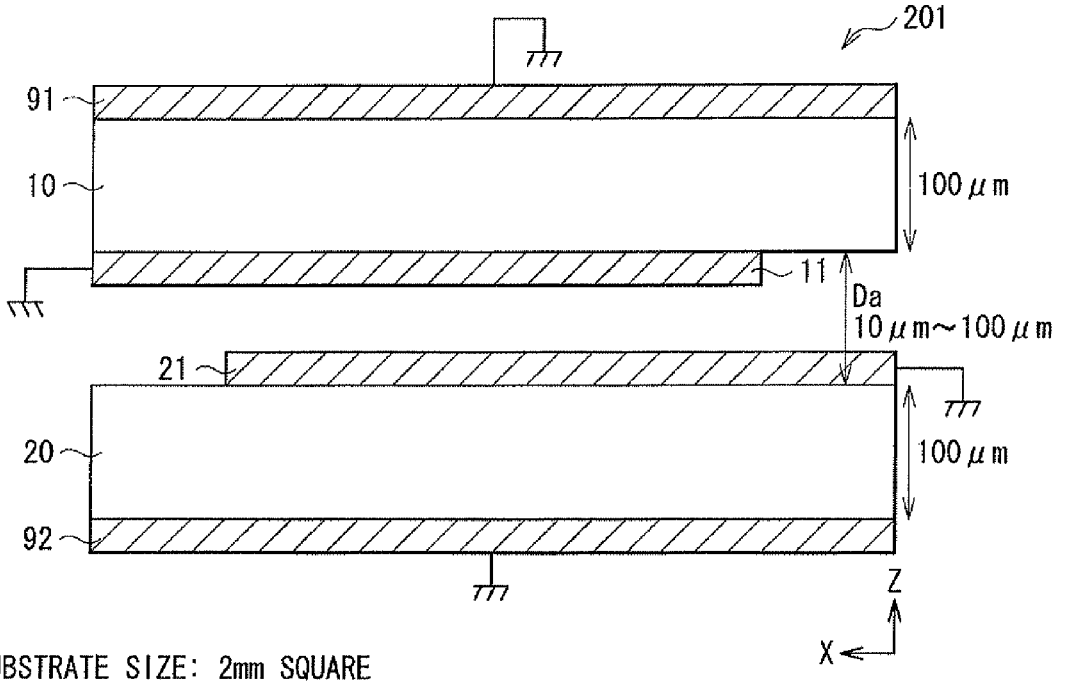

FIG. 11 is a cross-sectional view illustrating a specific design example of the resonator structure according to the comparative example.

Figure 12:
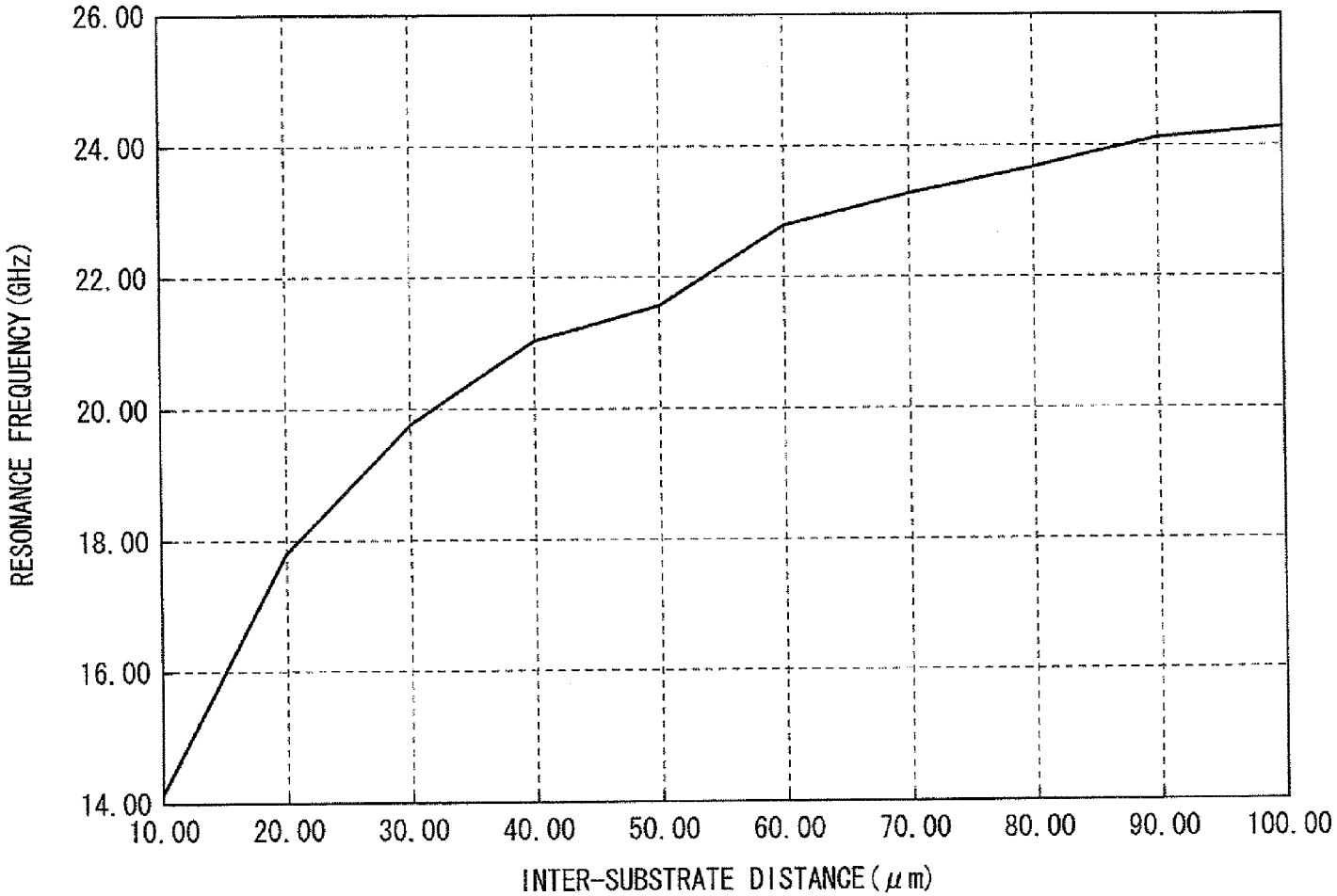

FIG. 12 is a characteristic diagram representing a resonance frequency characteristic of the resonator structure illustrated in FIG. 11.

Figure 1:
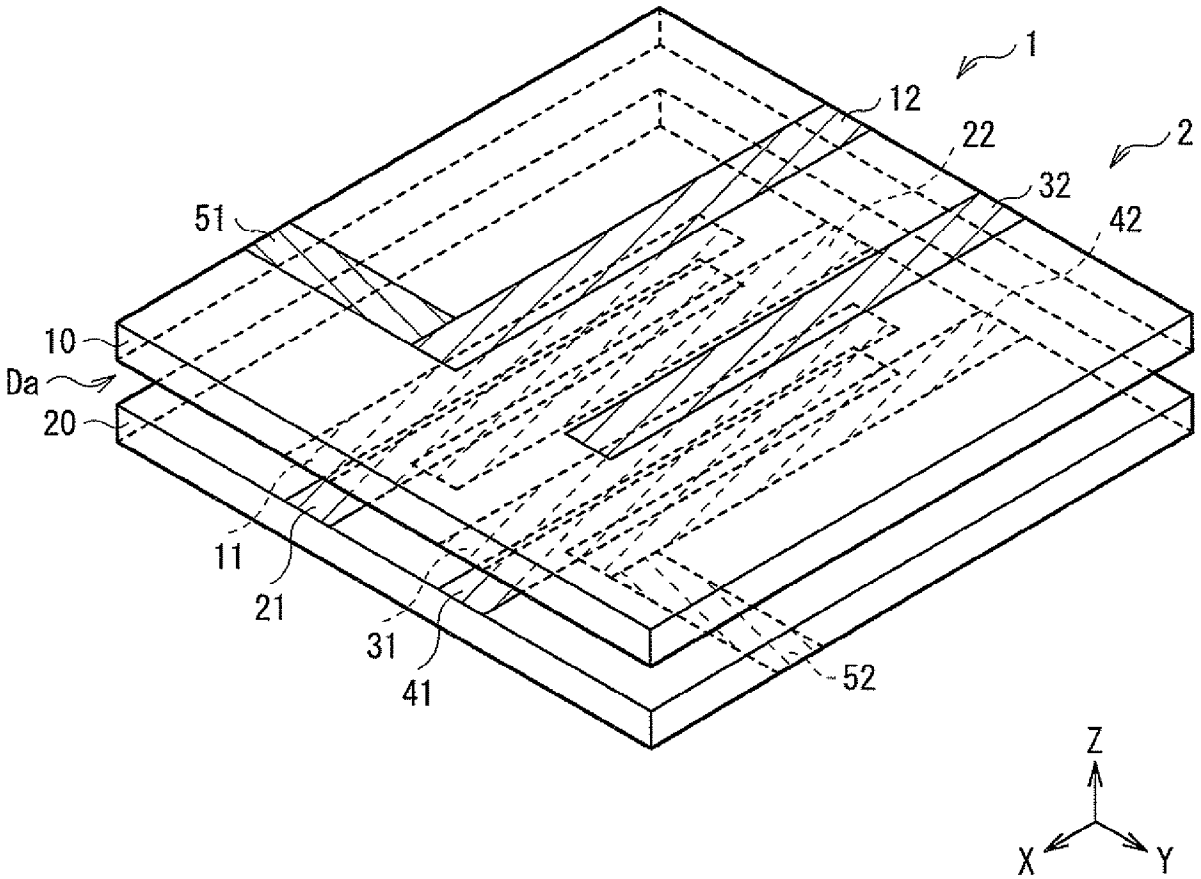
FIG. 1 is a perspective view illustrating an exemplary configuration of a signal transmission device (applicable also to a filter and an inter-substrate communication device) according to a first embodiment of the technology.
Figure 13:
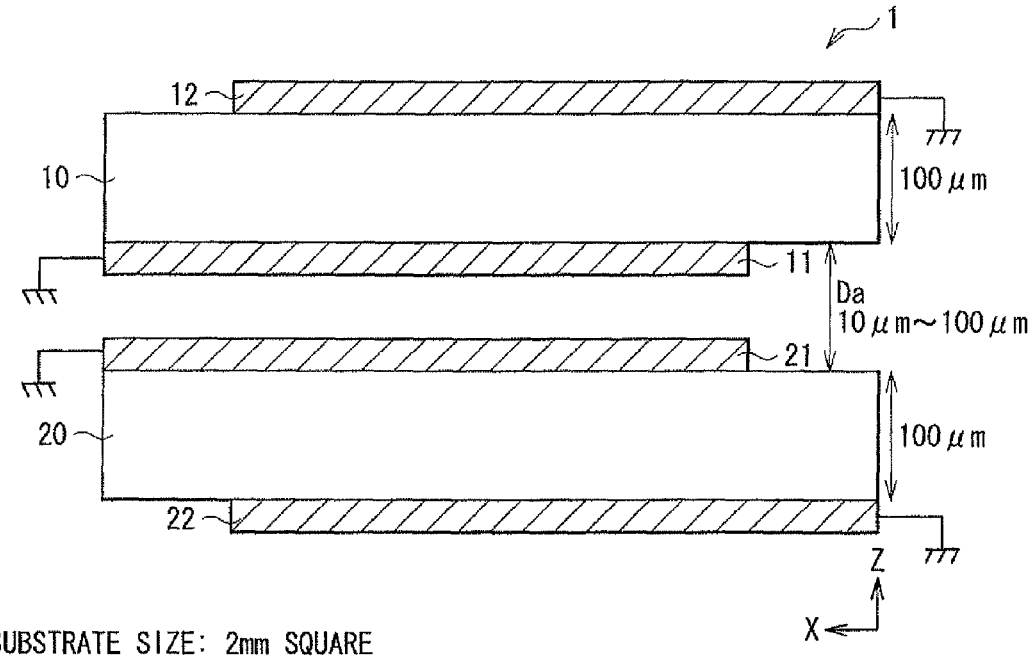

FIG. 13 is a cross-sectional view illustrating a specific design example of a first resonator in the signal transmission device illustrated in FIG. 1.

Figure 14:
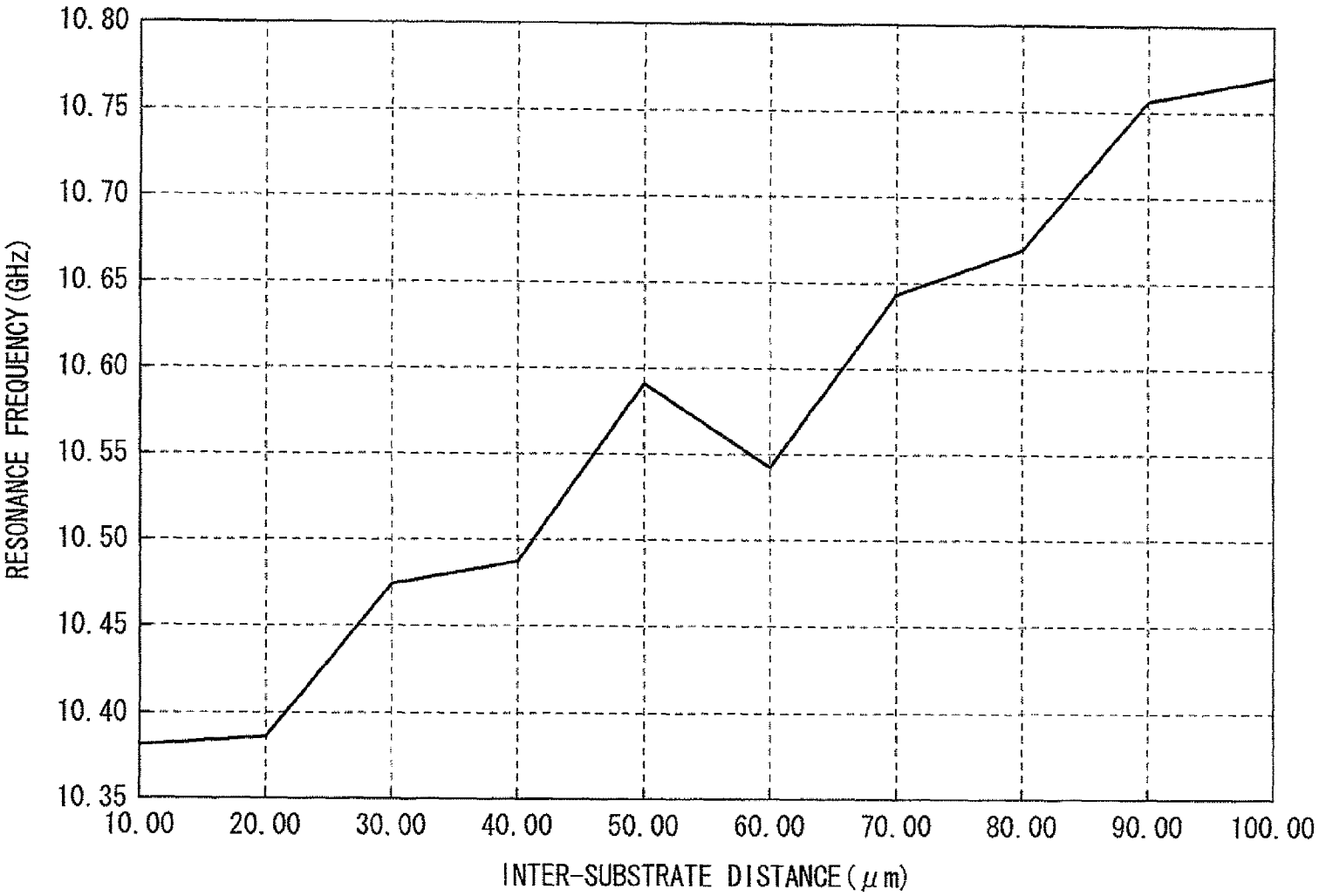

FIG. 14 is a characteristic diagram representing a resonance frequency characteristic of the first resonator illustrated in FIG. 13.

Figure 15A:
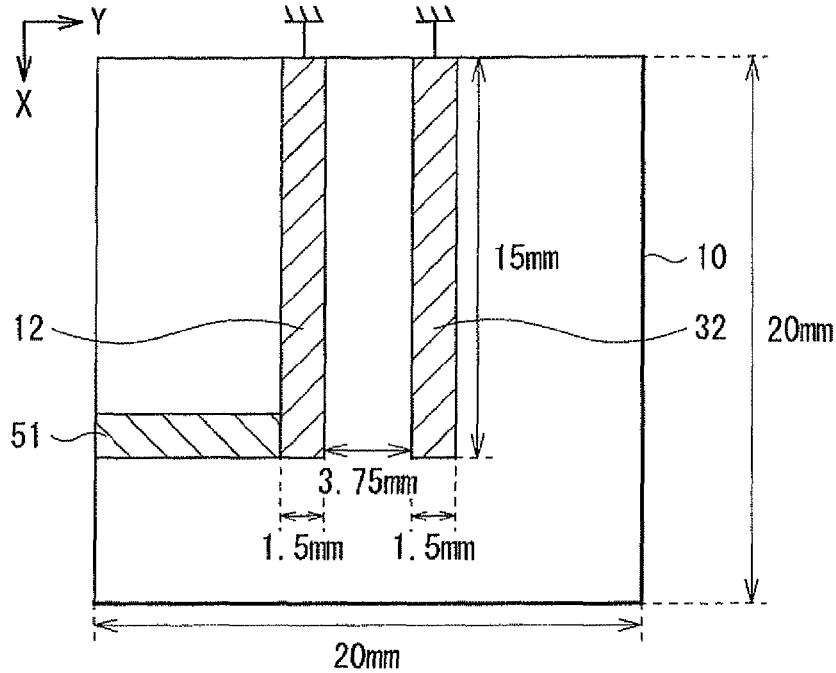
Figure 15B:
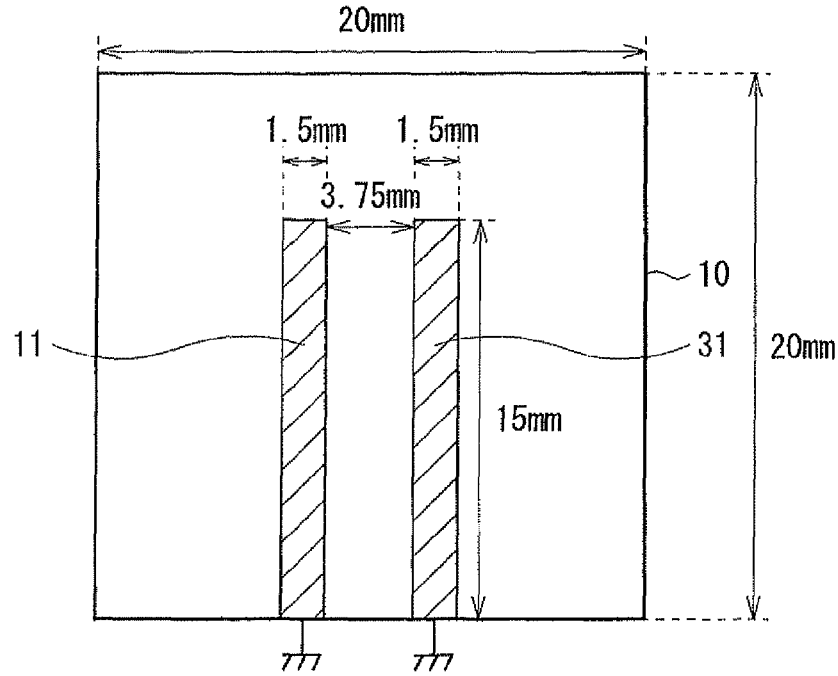

FIG. 15A is a plan view illustrating a specific design example of the front of the first substrate in the signal transmission device illustrated in FIG. 1, and FIG. 15B is a plan view illustrating a specific design example of the back of the first substrate.

Figure 16A:
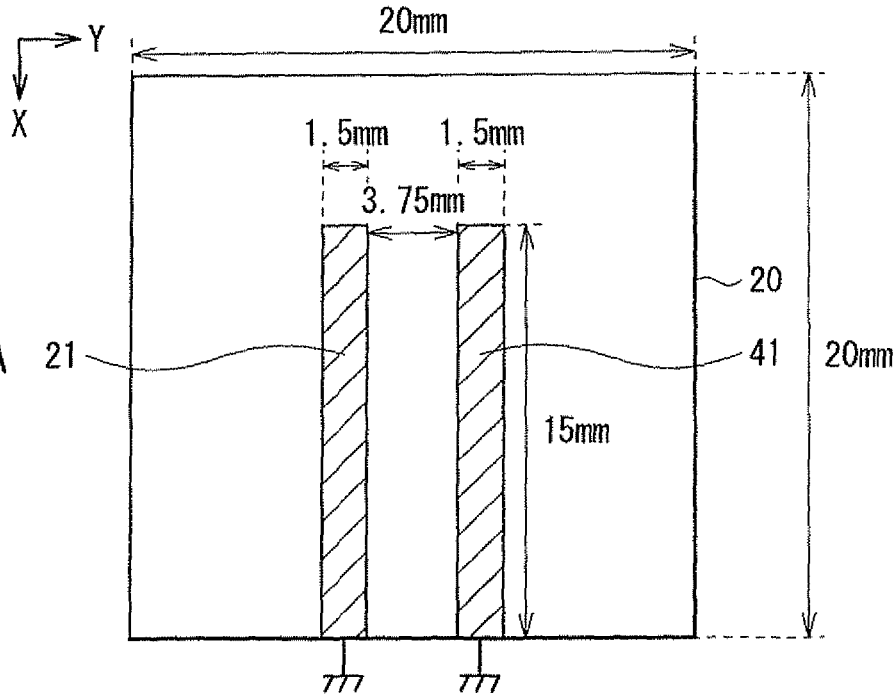
Figure 16B:
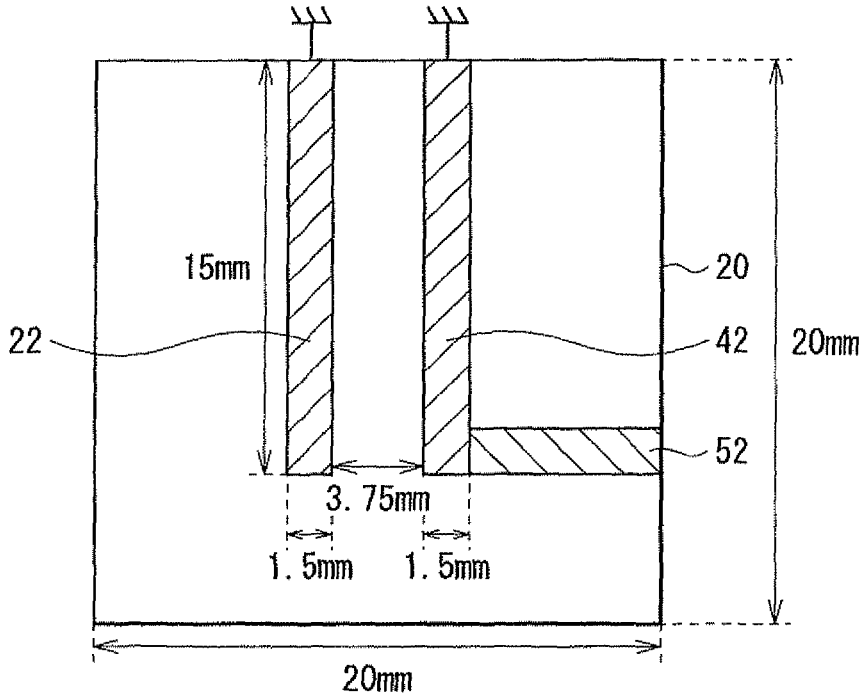

FIG. 16A is a plan view illustrating a specific design example of the front of the second substrate in the signal transmission device illustrated in FIG. 1, and FIG. 16B is a plan view illustrating a specific design example of the back of the second substrate.

Figure 17:
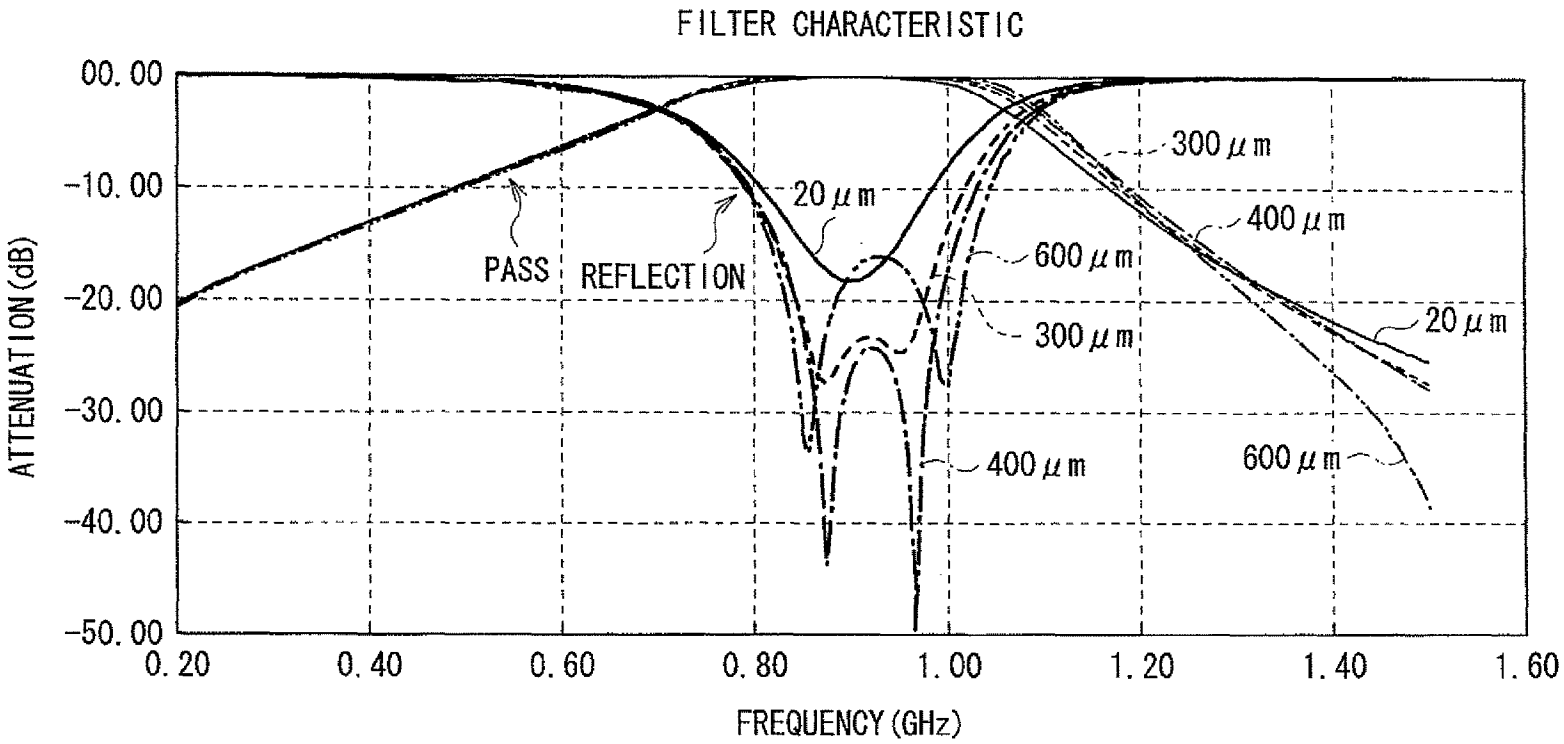

FIG. 17 is a characteristic diagram representing a filter characteristic of the concrete design example illustrated in FIGS. 15A and 15B and that of the concrete design example illustrated in FIGS. 16A and 16B.

Figure 18:
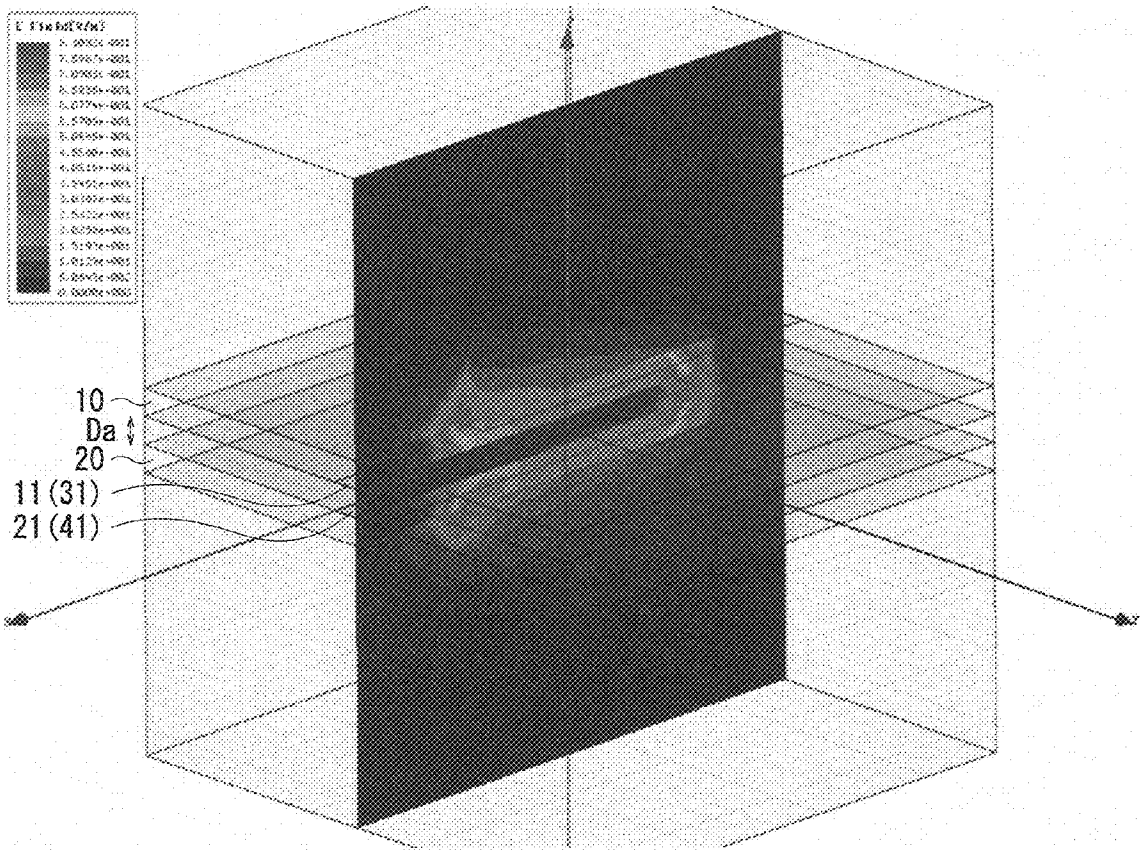

FIG. 18 describes an electric field distribution between the first substrate and the second substrate in the signal transmission device illustrated in FIG. 1.

Figure 19:
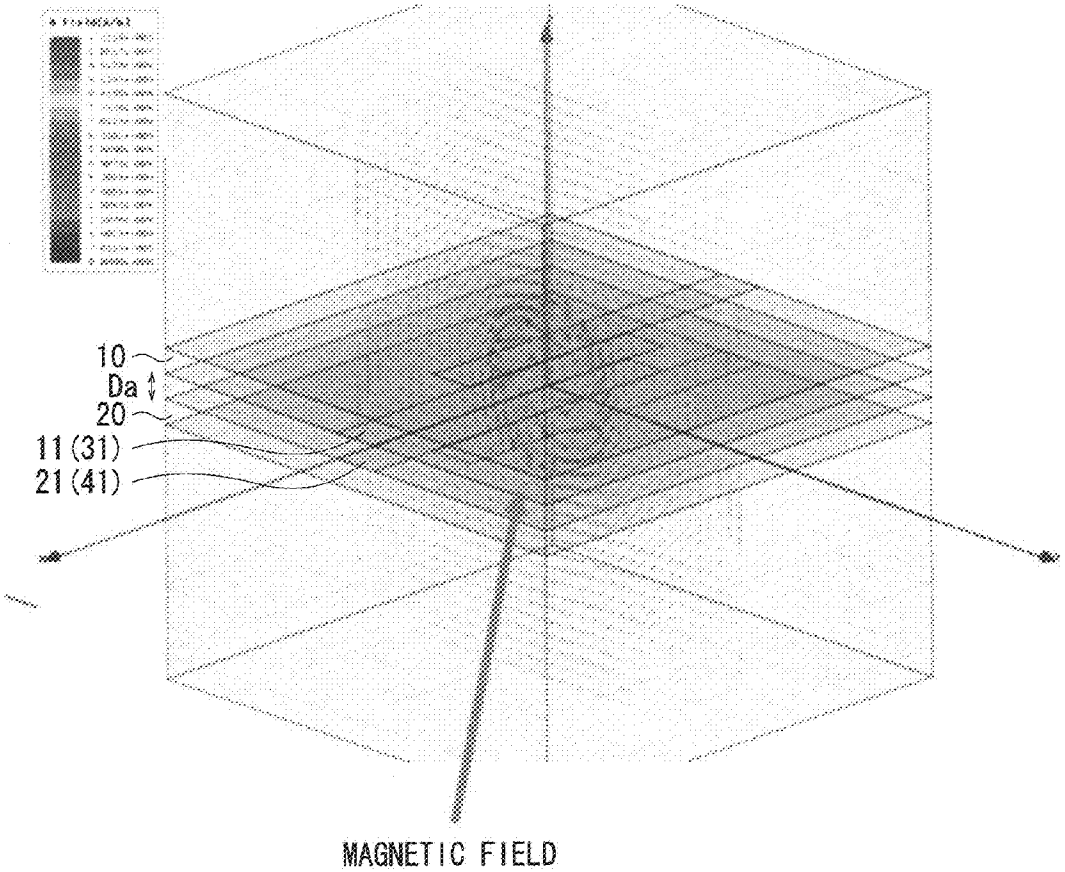

FIG. 19 describes a magnetic field distribution between the first substrate and the second substrate in the signal transmission device illustrated in FIG. 1.

Figure 20:
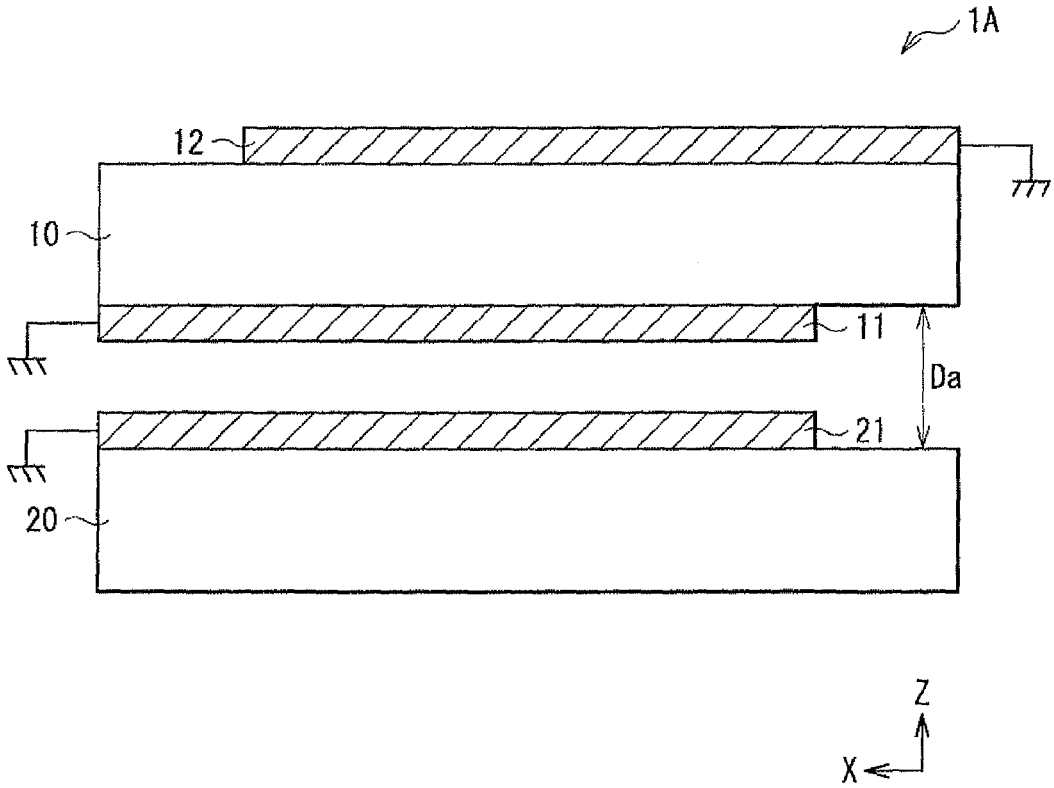

FIG. 20 is a cross-sectional view illustrating an exemplary configuration of a signal transmission device according to a second embodiment of the technology.

Figure 21:
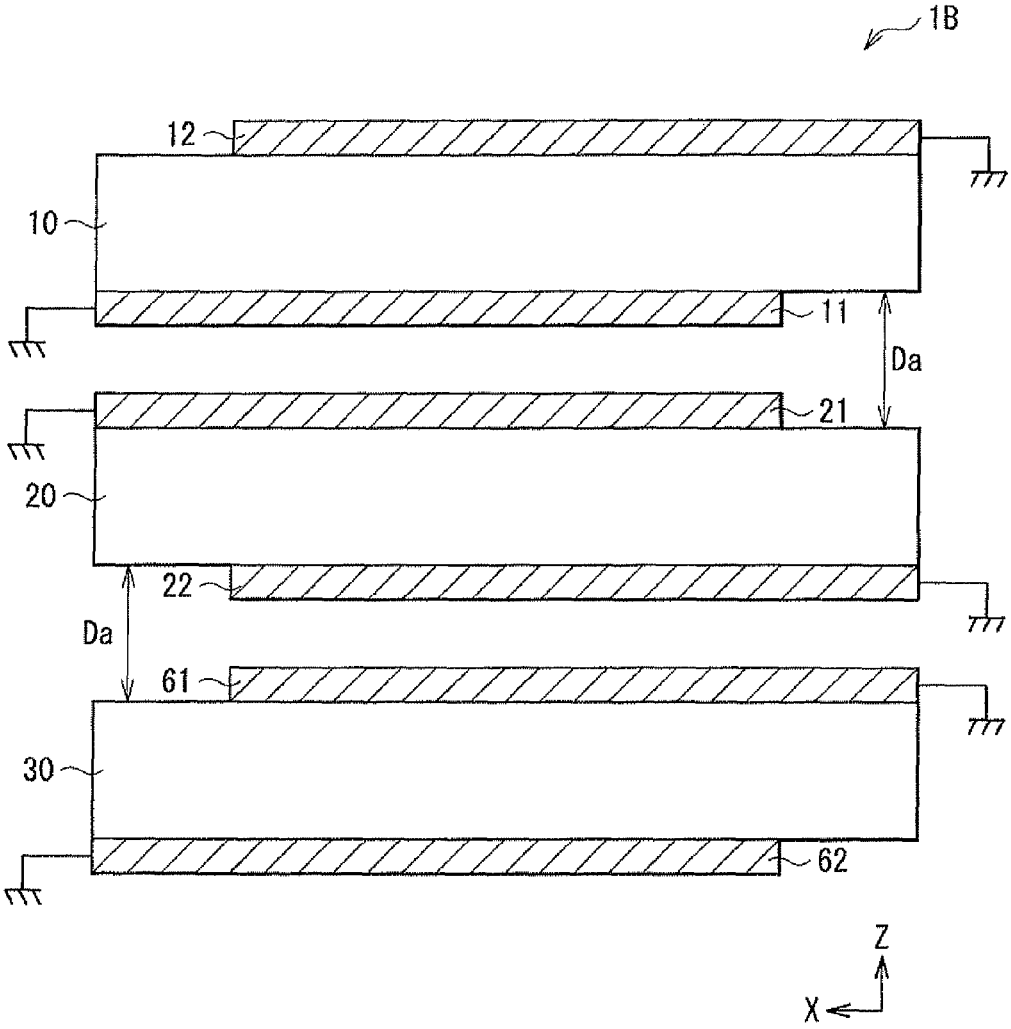

FIG. 21 is a cross-sectional view illustrating an exemplary configuration of a signal transmission device according to a third embodiment of the technology.

Figure 22:
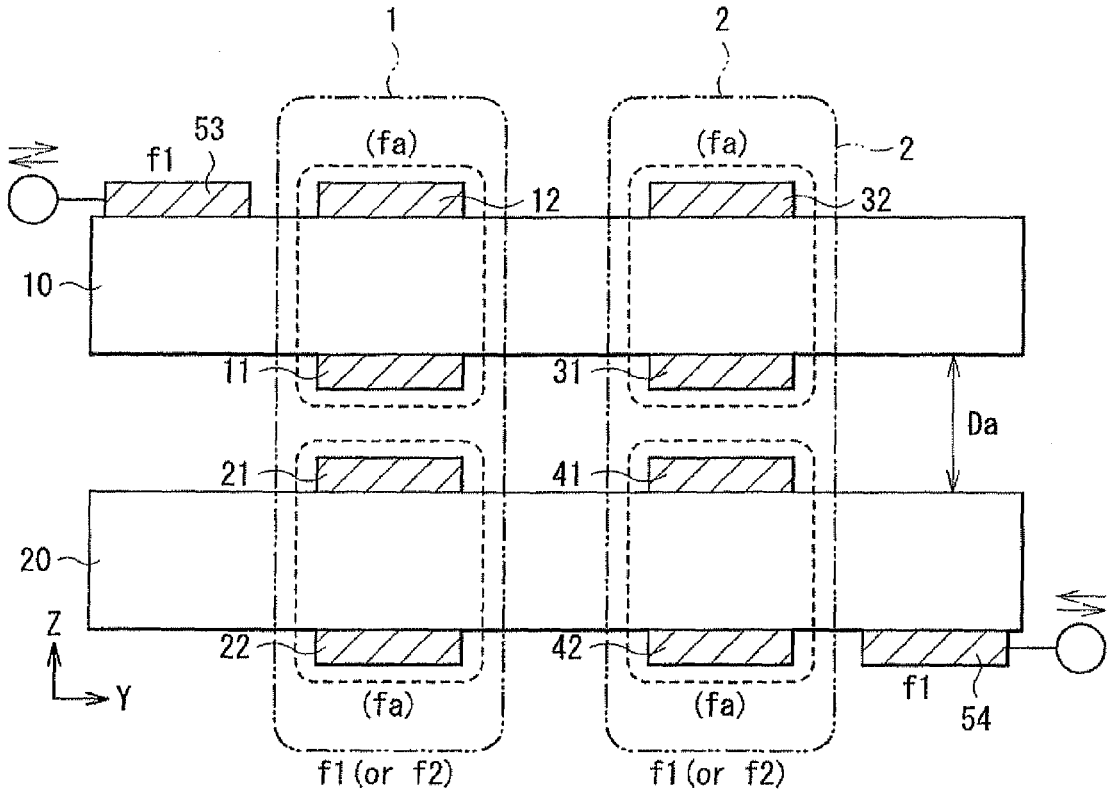

FIG. 22 is a cross-sectional view illustrating an exemplary configuration of a signal transmission device according to a fourth embodiment of the technology.

Figure 23:
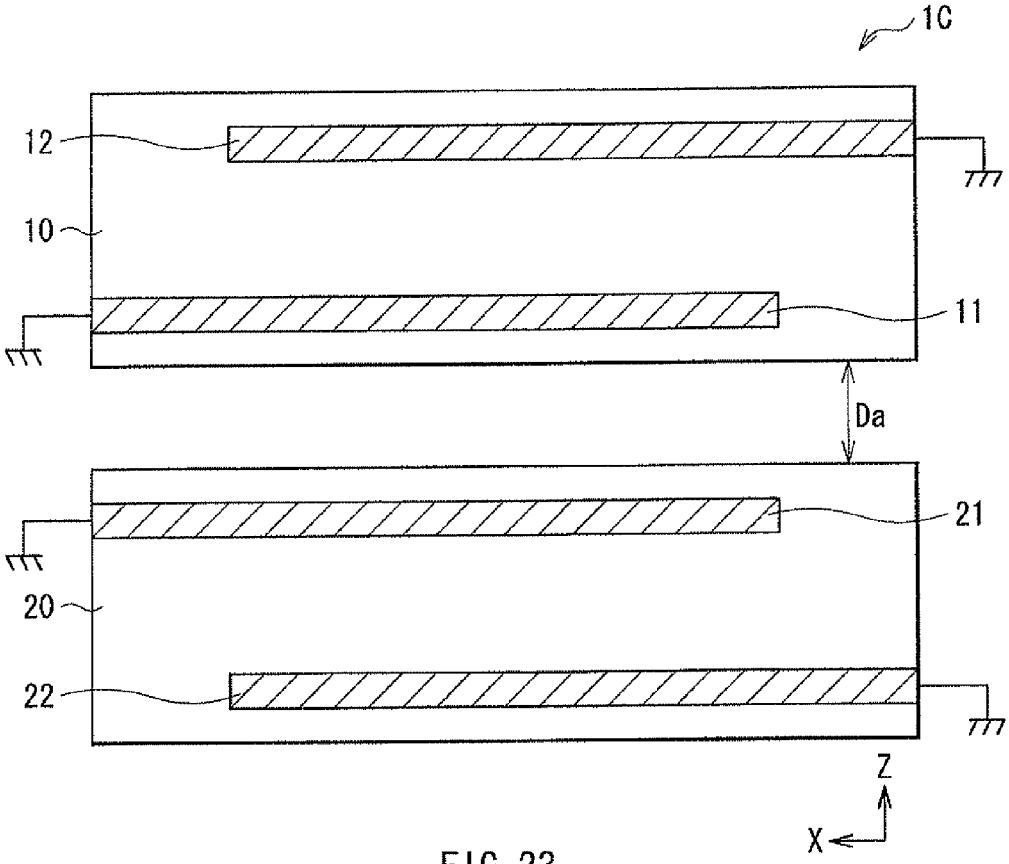

FIG. 23 is a cross-sectional view illustrating an exemplary configuration of a signal transmission device according to a fifth embodiment of the technology.

Figure 24:
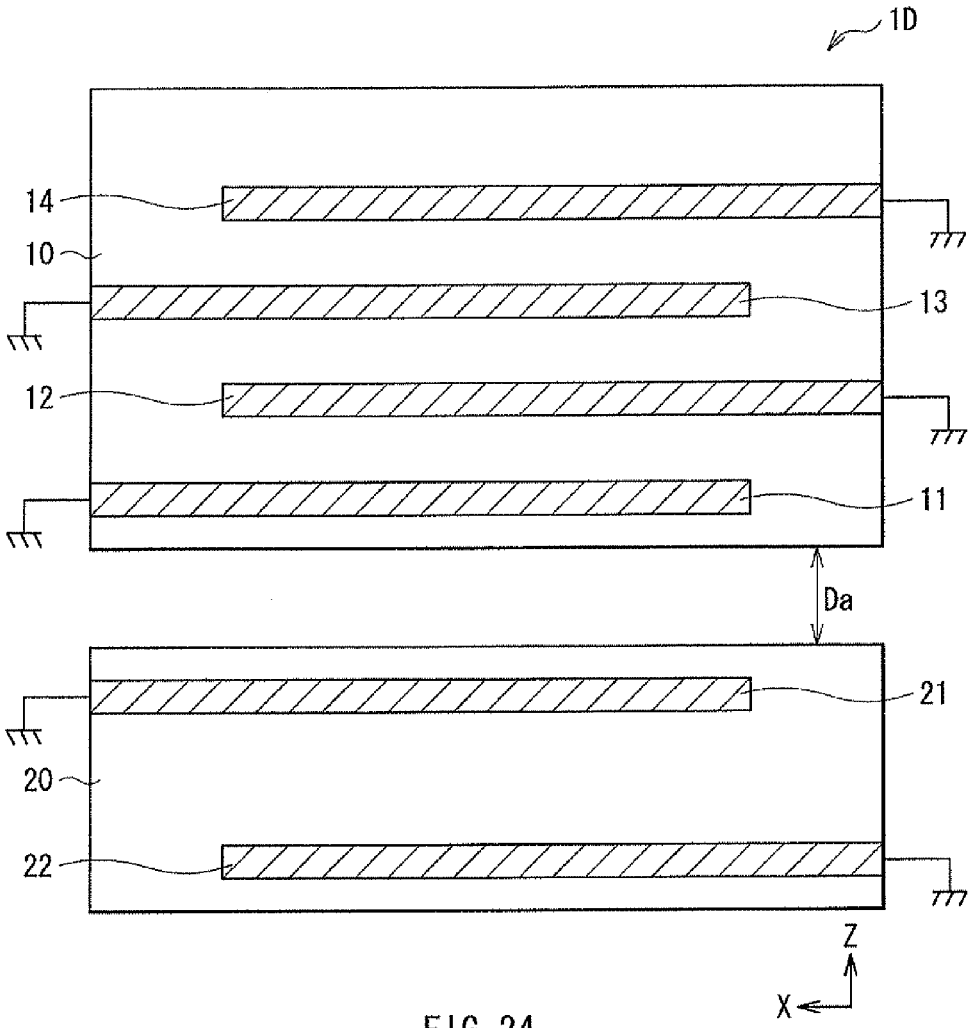

FIG. 24 is a cross-sectional view illustrating an exemplary configuration of a signal transmission device according to a sixth embodiment of the technology.

Figure 25:
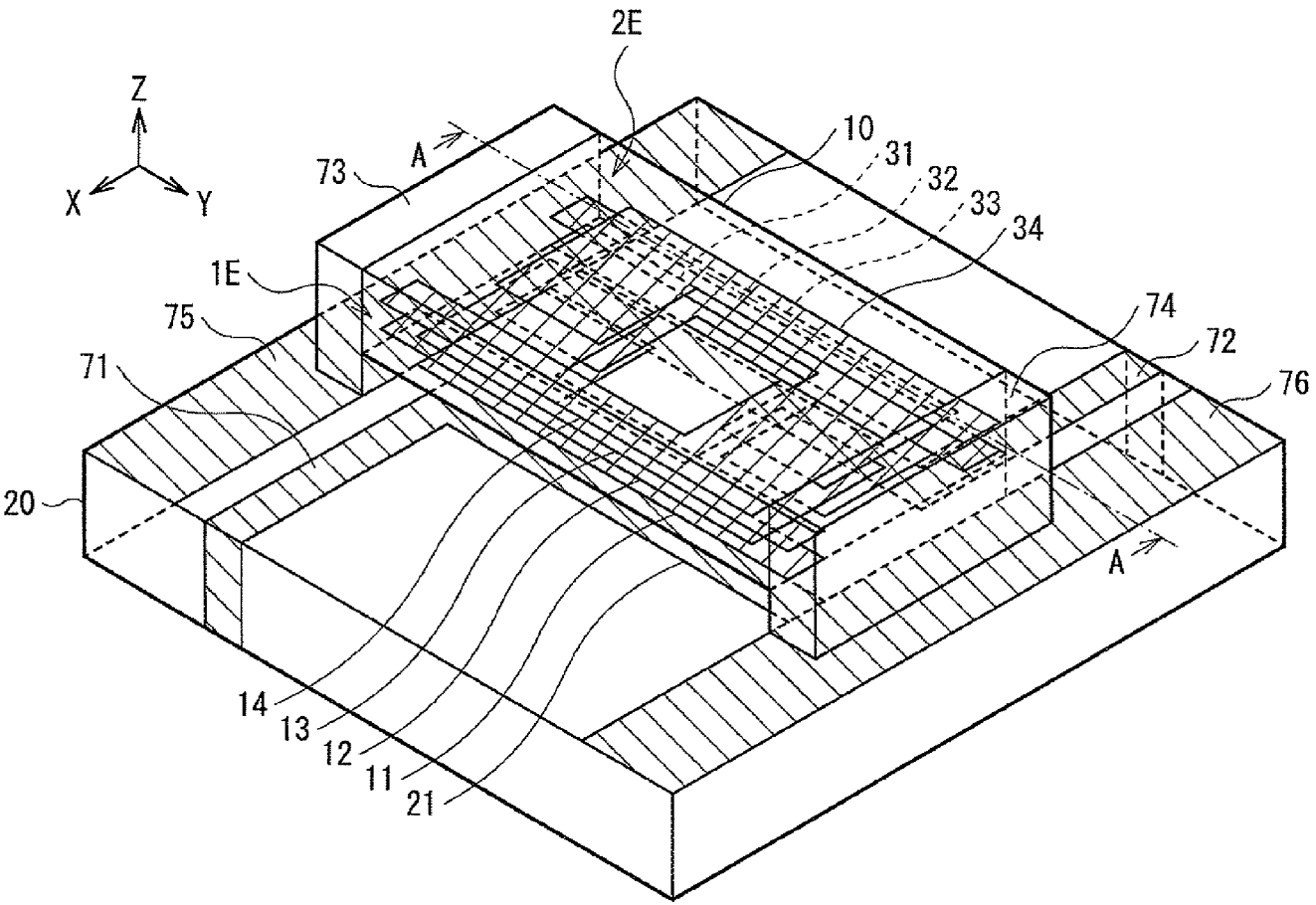

FIG. 25 is a cross-sectional view illustrating an exemplary configuration of a signal transmission device (or a filter) according to a seventh embodiment of the technology.

Figure 26:
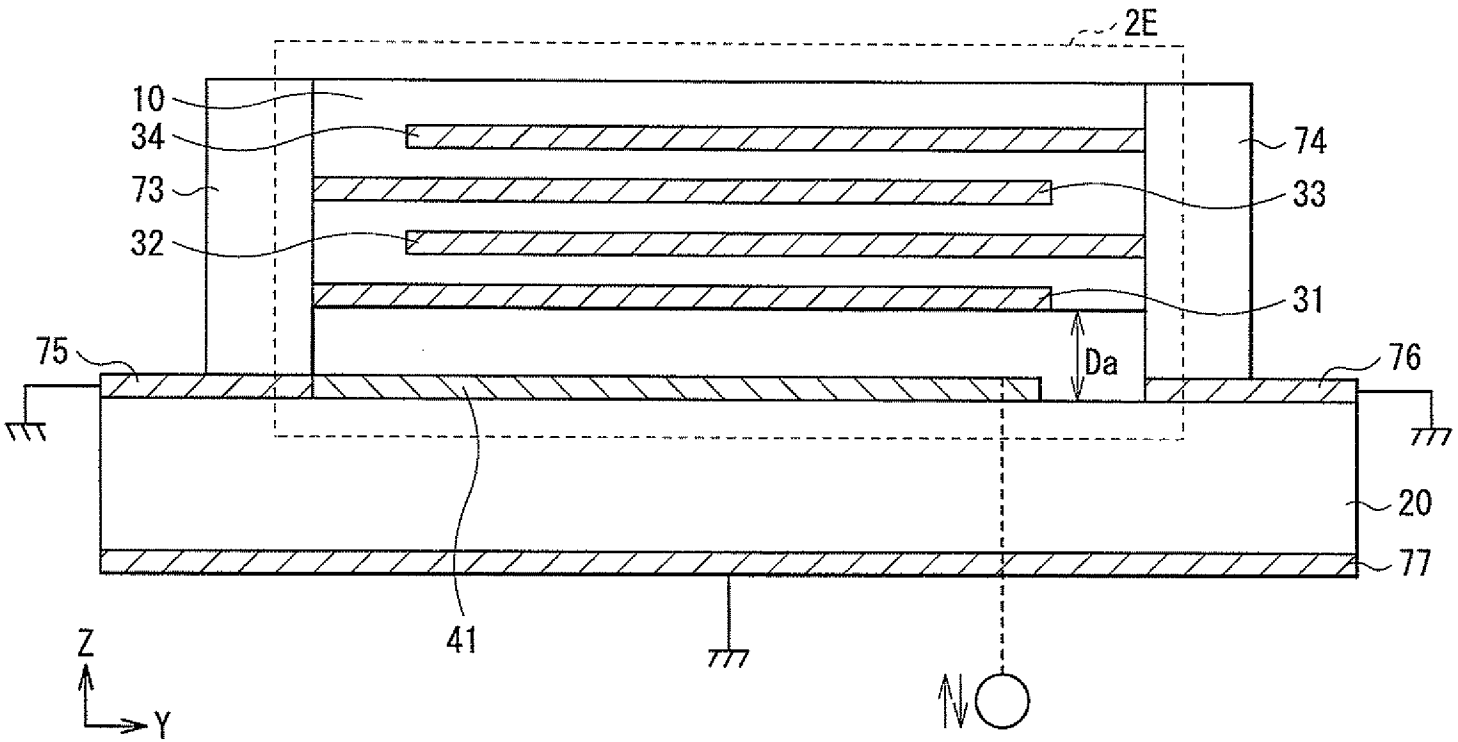

FIG. 26 is a cross-sectional view illustrating the configuration as viewed from the X-direction of the signal transmission device illustrated in FIG. 25.

Figure 27A:
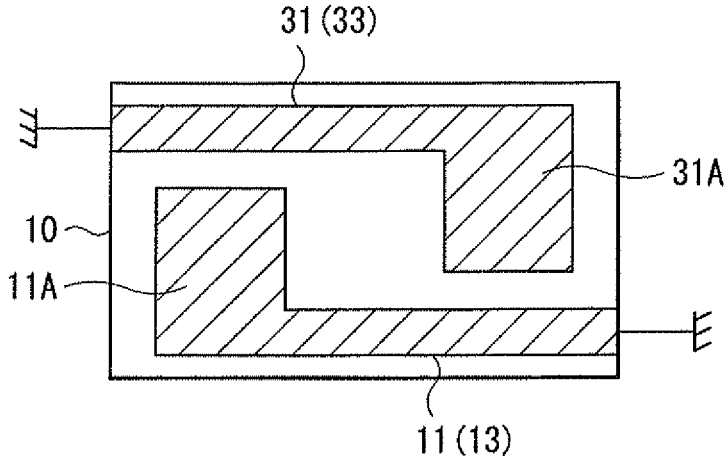
Figure 27B:
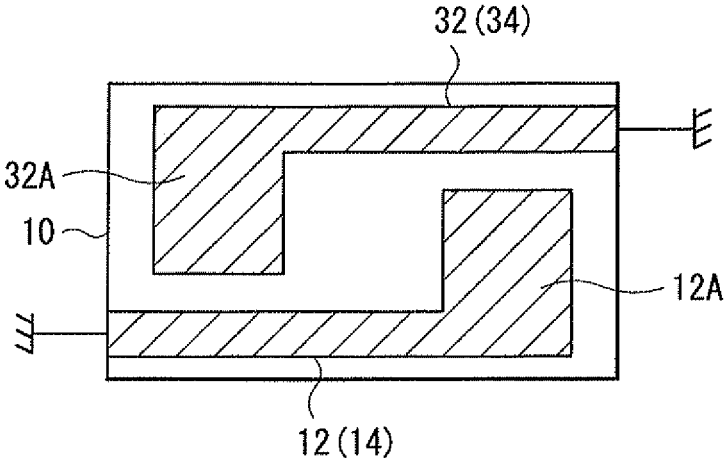

FIG. 27A is a plan view illustrating a resonator structure of a first layer from the bottom of a first substrate in the signal transmission device illustrated in FIG. 25, and FIG. 27B is a plan view illustrating a resonator structure of a second layer from the bottom of the first substrate.

Figure 28:
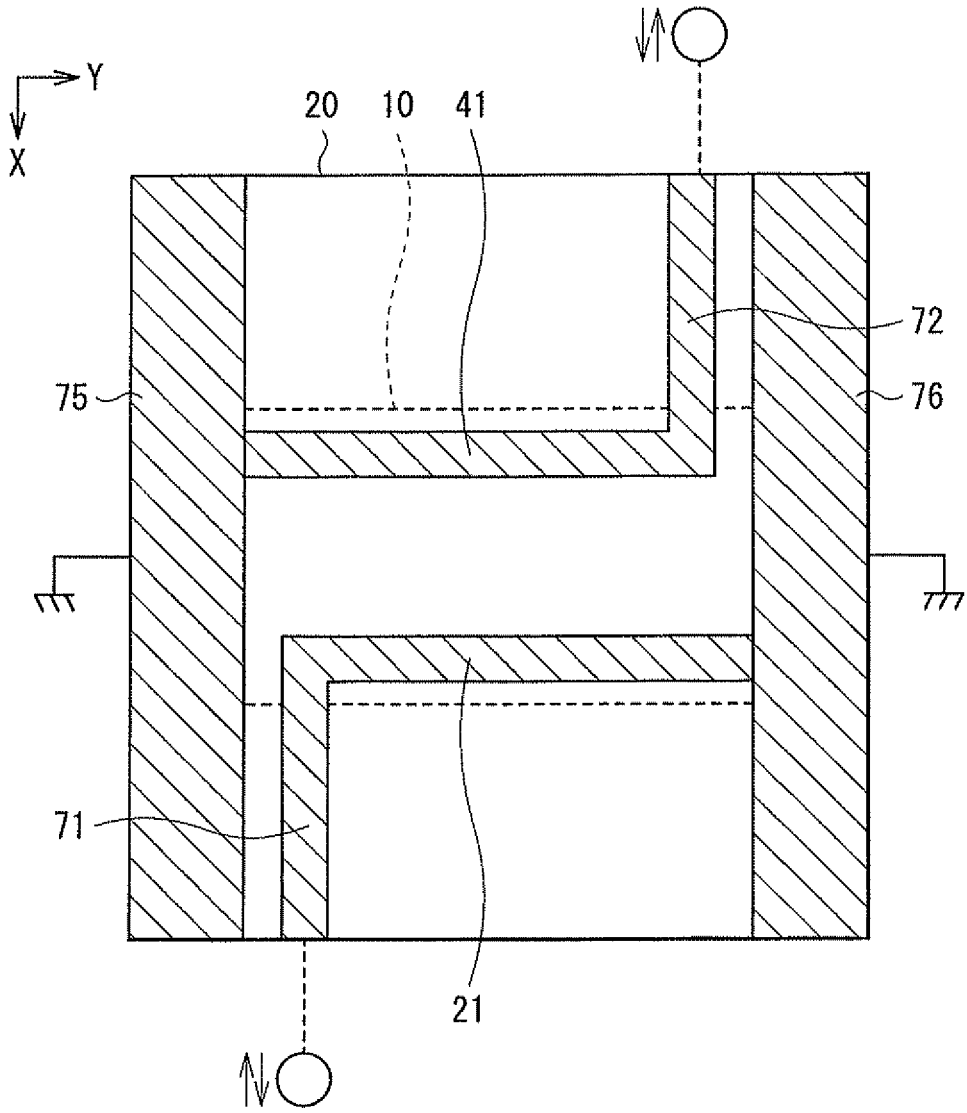

FIG. 28 is a plan view illustrating a resonator structure on the front of a second substrate in the signal transmission device illustrated in FIG. 25.

DETAILED DESCRIPTION

In the following, some embodiments of the technology will be described in detail with reference to the accompanying drawings.

[First Embodiment]

[Exemplary Configuration of Signal Transmission Device]

Figure 2:
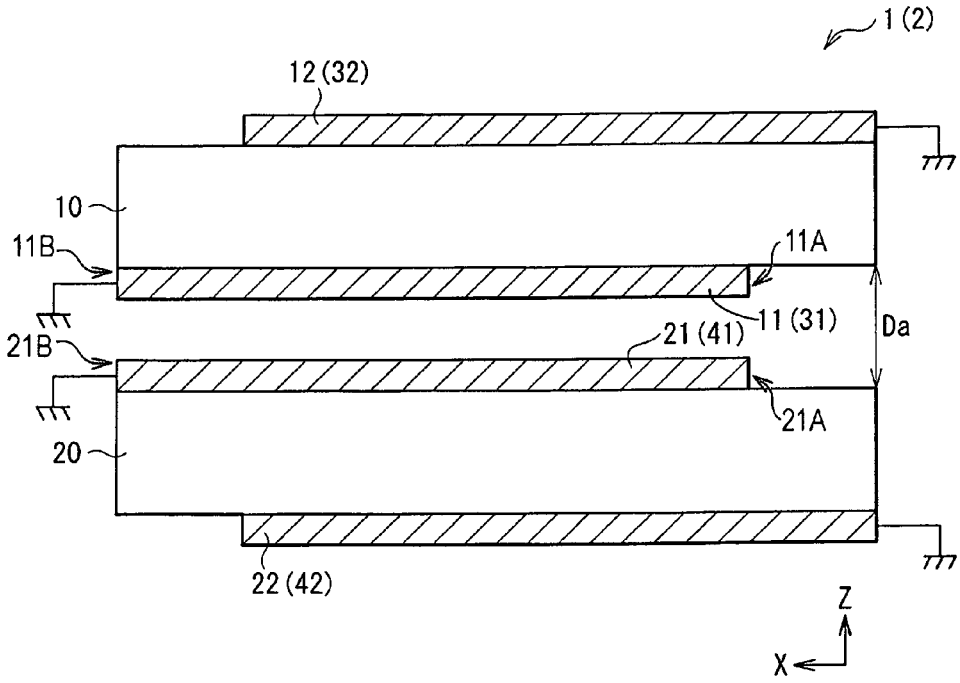
FIG. 2 is a cross-sectional view illustrating the configuration as viewed from a Y-direction of the signal transmission device illustrated in FIG. 1.

FIG. 1 illustrates an overall exemplary configuration of a signal transmission device (applicable also to a filter and an inter-substrate communication device) according to a first embodiment of the technology. FIG. 2 illustrates a cross-sectional configuration as viewed from a Y-direction of the signal transmission device illustrated in FIG. 1. The signal transmission device according to the first embodiment is provided with a first substrate 10 and a second substrate 20, which are disposed to oppose each other in a first direction (for example, a Z-direction in the drawing). The first substrate 10 and the second substrate 20 are each a dielectric substrate, and are so disposed to oppose each other, with a spacing in between (i.e., an inter-substrate distance Da), as to sandwich a layer made of a material different from a substrate material. The layer including the material different from the substrate material can be a layer having a dielectric constant different from that of the substrate material, such as, but not limited to, a layer of air. Each of the first substrate 10 and the second substrate 20 is formed with: a first resonator 1; and a second resonator 2 arranged side-by-side in a second direction (for example, a Y-direction in the drawing) relative to the first resonator 1, and electromagnetically coupled to the first resonator 1 to perform a signal transmission between the first resonator 1 and the second resonator 2. The first resonator 1 has a plurality of first quarter wavelength resonators 11 and 12 formed on the first substrate 10, and a plurality of second quarter wavelength resonators 21 and 22 formed on the second substrate 20. The second resonator 2 has a plurality of third quarter wavelength resonators 31 and 32 formed on the first substrate 10, and a plurality of fourth quarter wavelength resonators 41 and 42 formed on the second substrate 20.

The signal transmission device is further provided with a first signal-lead electrode 51 formed on the first substrate 10, and a second signal-lead electrode 52 formed on the second substrate 20. The plurality of first quarter wavelength resonators 11 and 12, the plurality of third quarter wavelength resonators 31 and 32, and the first signal-lead electrode 51 which are formed on the first substrate 10 are each configured of an electrode pattern made of a conductor. Likewise, the plurality of second quarter wavelength resonators 21 and 22, the plurality of fourth quarter wavelength resonators 41 and 42, and the second signal-lead electrode 52 which are formed on the second substrate 20 are each configured of an electrode pattern made of a conductor. It is to be noted that a thickness of each of the electrode patterns (such as the first quarter wavelength resonators 11 and 12) formed on the first substrate 10 and the second substrate 20 is omitted in FIG. 1.

Figure 3A:
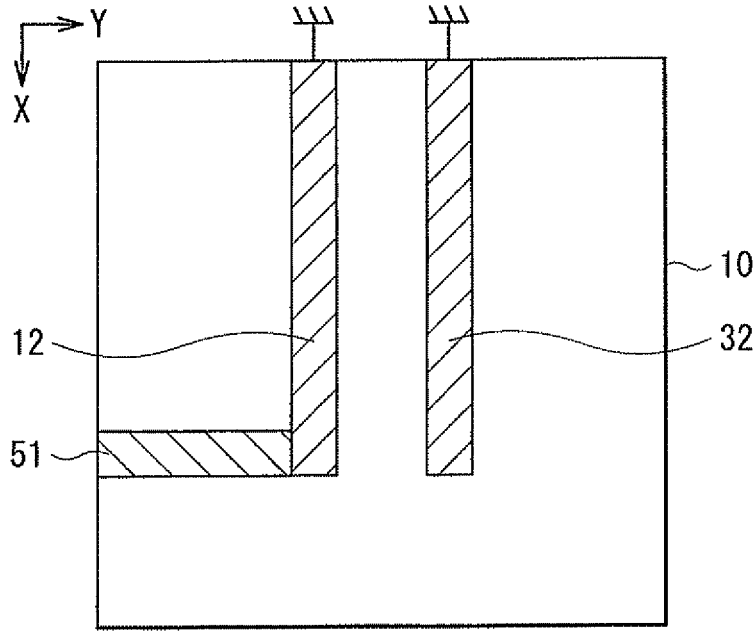
FIG. 3A is a plan view illustrating a resonator structure on the front of a first substrate in the signal transmission device illustrated in FIG. 1.
Figure 3B:
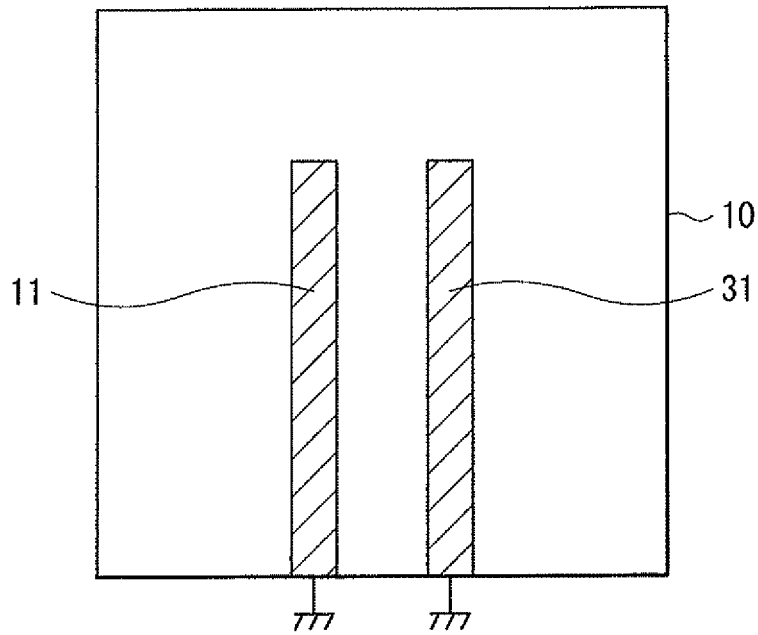
FIG. 3B is a plan view illustrating the resonator structure on the back of the first substrate.
Figure 4A:
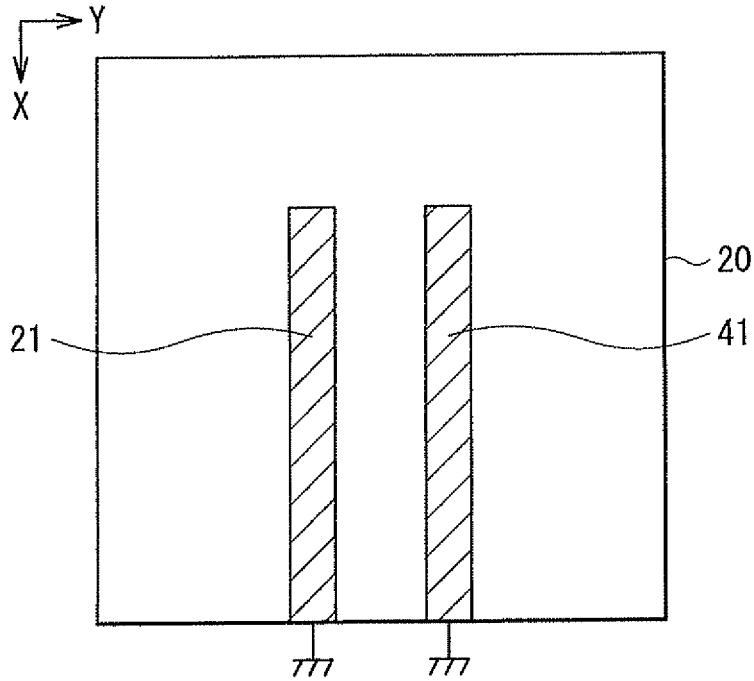
FIG. 4A is a plan view illustrating a resonator structure on the front of a second substrate in the signal transmission device illustrated in FIG. 1.
Figure 4B:
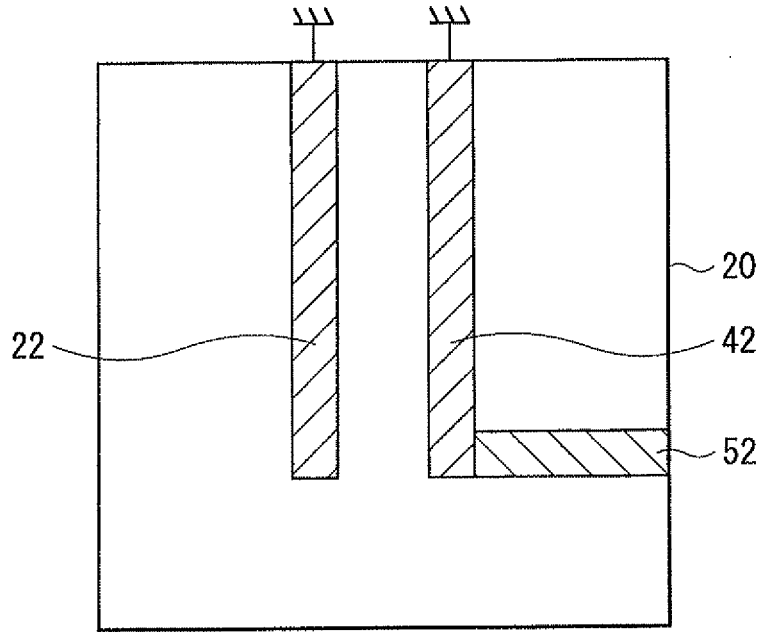
FIG. 4B is a plan view illustrating the resonator structure on the back of the second substrate.
Figure 5:
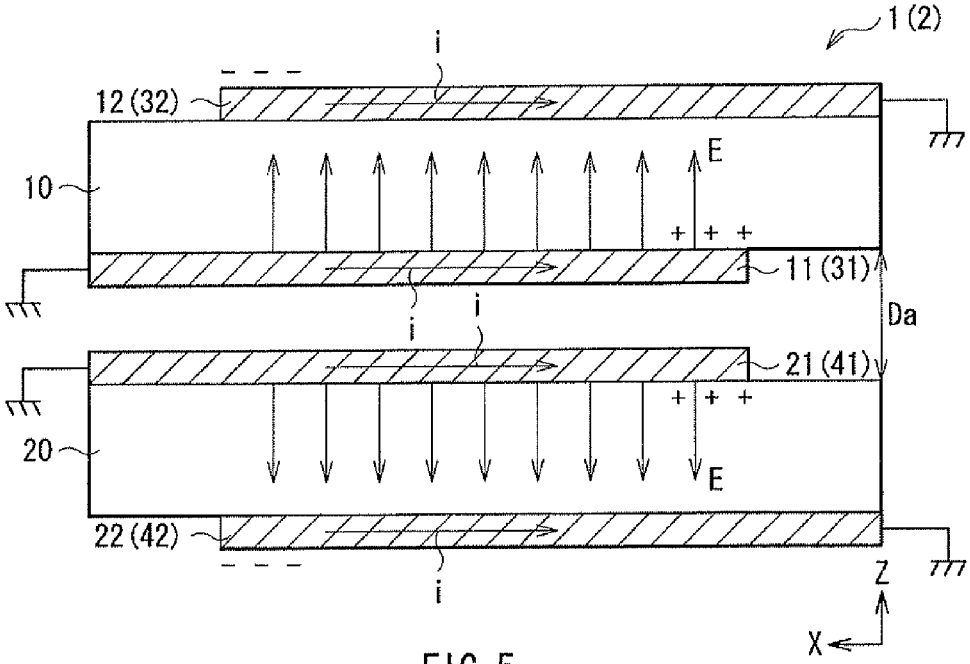
FIG. 5 describes an electric field distribution between the first substrate and the second substrate in the signal transmission device illustrated in FIG. 1.
Figure 6:
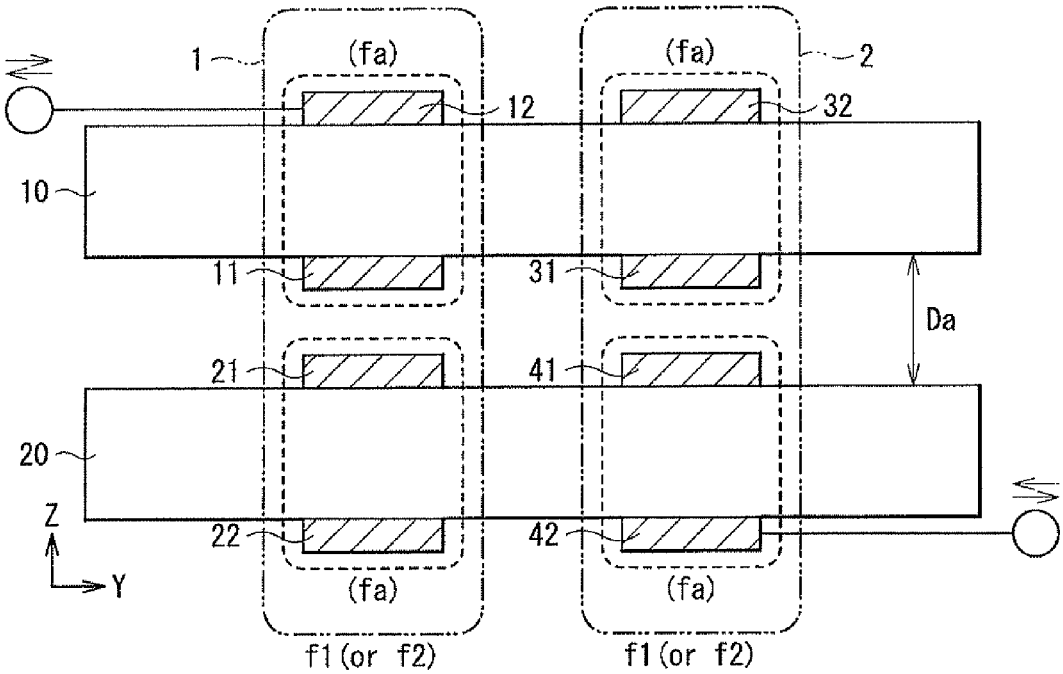
FIG. 6 is a cross-sectional view illustrating, together with a resonance frequency of each part of the substrates, the configuration as viewed from an X-direction of the signal transmission device illustrated in FIG. 1.

FIG. 3A illustrates a resonator structure on the front of the first substrate 10, and FIG. 3B illustrates the resonator structure on the back (on a side of the first substrate 10 opposing the second substrate 20) of the first substrate 10. FIG. 4A illustrates a resonator structure on the front (on a side of the second substrate 20 opposing the first substrate 10) of the second substrate 20, and FIG. 4B illustrates the resonator structure on the back of the second substrate 20. FIG. 5 schematically illustrates an electric field distribution between the first substrate 10 and the second substrate 20 (an electric field distribution in a first resonance frequency f1 according to a hybrid resonance mode, as will be described later). FIG. 6 illustrates, together with a resonance frequency of each part of the substrates 10 and 20, a cross-sectional configuration as viewed from an X-direction of the signal transmission device illustrated in FIG. 1.

The plurality of first quarter wavelength resonators 11 and 12 are interdigitally coupled to each other in the first direction (the Z-direction in the drawing) in a first region of the first substrate 10. One of the first quarter wavelength resonators (for example, the first quarter wavelength resonator 11) is formed on the back of the first substrate 10, whereas the other of the first quarter wavelength resonators (for example, the first quarter wavelength resonator 12) is formed on the front of the first substrate 10. The plurality of second quarter wavelength resonators 21 and 22 are interdigitally coupled to each other in the first direction in a region of the second substrate 20 which corresponds to the first region. Thereby, the first resonator 1 is formed having a configuration in which the plurality of first quarter wavelength resonators 11 and 12 and the plurality of second quarter wavelength resonators 21 and 22 are disposed and stacked in the first direction in the first region, as illustrated in FIG. 6. Also, in the first resonator 1, the first quarter wavelength resonator 11 and the second quarter wavelength resonator 21, which are located at positions nearest to each other in the first resonator 1, are so disposed that respective open ends (11A which is an open end of the one first quarter wavelength resonator 11; and 21A, which is an open end of the one second quarter wavelength resonator) thereof are opposed to each other and respective short-circuit ends (11B, which is a short-circuit end of the first quarter wavelength resonator 11; and 21B, which is a short-circuit end of the second quarter wavelength resonator 21) thereof are opposed to each other. Thereby, the first quarter wavelength resonator 11 and the second quarter wavelength resonator 21 are coupled, such as via the air layer, to each other through an electromagnetic coupling primarily involving a magnetic field component (a magnetic field coupling).

The interdigital coupling as used herein refers to a coupling scheme in which two resonators, each having a first end serving as a short-circuit end and a second end serving as an open end, are so disposed that the open end of the first resonator and the short-circuit end of the second resonator are opposed to each other and that the short-circuit end of the first resonator and the open end of the second resonator are opposed to each other, so as to allow those two resonators to be electromagnetically coupled to each other.

The plurality of third quarter wavelength resonators 31 and 32 are interdigitally coupled to each other in the first direction (the Z-direction in the drawing) in a second region of the first substrate 10. One of the third quarter wavelength resonators (for example, the third quarter wavelength resonator 31) is formed on the back of the first substrate 10, whereas the other of the third quarter wavelength resonators (for example, the third quarter wavelength resonator 32) is formed on the front of the first substrate 10. The plurality of fourth quarter wavelength resonators 41 and 42 are interdigitally coupled to each other in the first direction in a region of the second substrate 20 which corresponds to the second region. Thereby, the second resonator 2 is formed having a configuration in which the plurality of third quarter wavelength resonators 31 and 32 and the plurality of fourth quarter wavelength resonators 41 and 42 are disposed and stacked in the first direction in the second region different from the first region, as illustrated in FIG. 6. Also, in the second resonator 2, the third quarter wavelength resonator 31 and the fourth quarter wavelength resonator 41, which are located at positions nearest to each other in the second resonator 2, are so disposed that respective open ends thereof are opposed to each other and respective short-circuit ends thereof are opposed to each other. Thereby, the third quarter wavelength resonator 31 and the fourth quarter wavelength resonator 41 are coupled, such as via the air layer, to each other through the electromagnetic coupling which primarily involves the magnetic field component (the magnetic field coupling).

The first signal-lead electrode 51 is formed on the front of the first substrate 10, and is directly connected physically to the first quarter wavelength resonator 12 provided on the front of the first substrate 10 to be in conduction directly with the first quarter wavelength resonator 12, thereby allowing a signal transmission to be established between the first signal-lead electrode 51 and the first resonator 1. The second signal-lead electrode 52 is formed on the back of the second substrate 20, and is directly connected physically to the fourth quarter wavelength resonator 42 provided on the back of the second substrate 20 to be in conduction directly with the fourth quarter wavelength resonator 42, thereby allowing a signal transmission to be established between the second signal-lead electrode 52 and the second resonator 2. The first resonator 1 and the second resonator 2 are electromagnetically coupled to each other, allowing a signal transmission to be established between the first signal-lead electrode 51 and the second signal-lead electrode 52. Hence, the signal transmission between the two substrates of the first substrate 10 and the second substrate 20 is possible.

In an alternative embodiment, the first signal-lead electrode 51 may be formed on the back of the first substrate 10, and may be directly connected physically to the first quarter wavelength resonator 11 provided on the back of the first substrate 10 to be in conduction directly with the first quarter wavelength resonator 11. Likewise, the second signal-lead electrode 52 may be formed on the front of the second substrate 20, and may be directly connected physically to the fourth quarter wavelength resonator 41 provided on the front of the second substrate 20 to be in conduction directly with the fourth quarter wavelength resonator 41.

[Operation and Action]

In the signal transmission device according to the first embodiment, the first quarter wavelength resonator 11 and the second quarter wavelength resonator 21, which are located at positions nearest to each other between the first substrate 10 and the second substrate 20, are subjected to the electromagnetic coupling involving primarily the magnetic field component. In this state, the first quarter wavelength resonator 11 and the second quarter wavelength resonator 21 have the same potential, by which no electric field is generated between those resonators as illustrated in FIG. 5. The first quarter wavelength resonator 11 and the second quarter wavelength resonator 21 are thus coupled to each other substantially based on the magnetic coupling only. Thus, in the first resonator 1, there is hardly any electric field distribution in an element such as, but not limited to, the air layer between the first substrate 10 and the second substrate 20, thereby making it possible to suppress a variation in a resonance frequency in the first resonator 1 even when a variation is occurred in the inter-substrate distance Da of the element such as, but not limited to, the air layer between the first substrate 10 and the second substrate 20. Likewise, the third quarter wavelength resonator 31 and the fourth quarter wavelength resonator 41, which are located at positions nearest to each other between the first substrate 10 and the second substrate 20, are subjected to the electromagnetic coupling involving primarily the magnetic field component. Thereby, in the second resonator 2, there is hardly any electric field distribution in an element such as, but not limited to, the air layer between the first substrate 10 and the second substrate 20. The third quarter wavelength resonator 31 and the fourth quarter wavelength resonator 41 are thus coupled to each other substantially based on the magnetic coupling only. This suppresses the variation in the resonance frequency in the second resonator 2 even when the variation is occurred in the inter-substrate distance Da of the element such as, but not limited to, the air layer between the first substrate 10 and the second substrate 20. Hence, a variation in factors such as a pass frequency and a pass band caused by the variation in the inter-substrate distance Da is suppressed.

Also, in the signal transmission device according to the first embodiment, the plurality of first quarter wavelength resonators 11 and 12 and the plurality of second quarter wavelength resonators 21 and 22 are electromagnetically coupled based on the later-described hybrid resonance mode, by which the first resonator 1 structures a single coupled resonator which resonates at the first resonance frequency f1 (or at a second resonance frequency f2) as a whole, as illustrated in FIG. 6. In addition thereto, in a state where the first substrate 10 and the second substrate 20 are sufficiently separated away from each other such that they are not or they fail to be electromagnetically coupled to each other, a resonance frequency fa derived from the plurality of first quarter wavelength resonators 11 and 12 alone and the resonance frequency fa derived from the plurality of second quarter wavelength resonators 21 and 22 alone are each a frequency different from the first resonance frequency f1 (or different from the second resonance frequency f2).

Likewise, the plurality of third quarter wavelength resonators 31 and 32 and the plurality of fourth quarter wavelength resonators 41 and 42 are electromagnetically coupled based on the hybrid resonance mode, by which the second resonator 2 structures a single coupled resonator which resonates at the first resonance frequency f1 (or at the second resonance frequency f2) as a whole, as illustrated in FIG. 6. In addition thereto, in a state where the first substrate 10 and the second substrate 20 are sufficiently separated away from each other such that they are not electromagnetically coupled to each other, the resonance frequency fa derived from the plurality of third quarter wavelength resonators 31 and 32 alone and the resonance frequency fa derived from the plurality of fourth quarter wavelength resonators 41 and 42 alone are each a frequency different from the first resonance frequency f1 (or different from the second resonance frequency 12).

Thus, a frequency characteristic in the state where the first substrate 10 and the second substrate 20 are so sufficiently separated away from each other that they are not electromagnetically coupled to each other, and a frequency characteristic in the state where the first substrate 10 and the second substrate 20 are electromagnetically coupled to each other, are different. Hence, when the first substrate 10 and the second substrate 20 are electromagnetically coupled to each other, the signal transmission is performed based on the first resonance frequency f1 (or based on the second resonance frequency f2), for example. On the other hand, when the first substrate 10 and the second substrate 20 are so sufficiently separated away from each other that they are not electromagnetically coupled to each other, the resonance is performed at the sole resonance frequency fa. Hence, the signal transmission is not performed based on the first resonance frequency f1 (or based on the second resonance frequency 12). Consequently, in the state where the first substrate 10 and the second substrate 20 are sufficiently separated away from each other, a signal having the same bandwidth as the first resonance frequency f1 (or the second resonance frequency 12) will be subjected to reflection even when that signal is inputted, thereby making it possible to prevent the leakage of signal from the resonators.

[Principle of Signal Transmission Based on Hybrid Resonance Mode]

Figure 7:
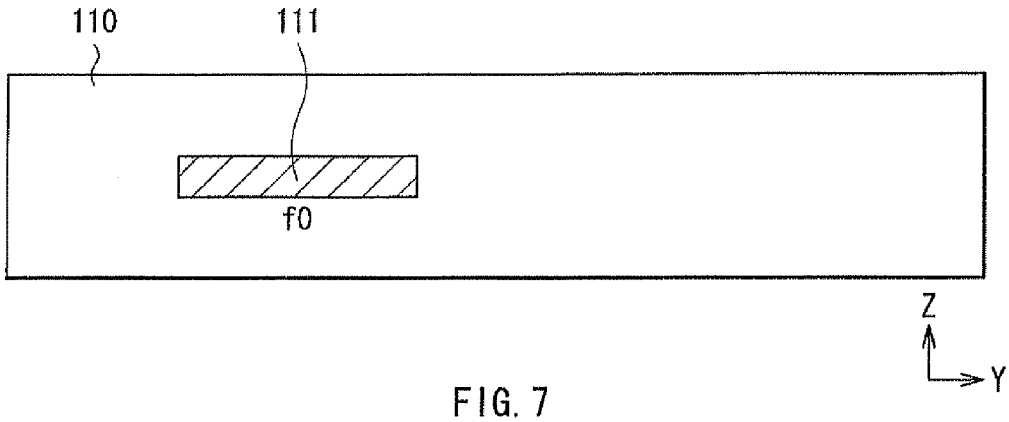
FIG. 7 is a cross-sectional view illustrating a substrate having a resonator structure according to a comparative example.

Description will now be made on a principle of the signal transmission based on the hybrid resonance mode mentioned above. For the purpose of convenience in description, a resonator structure according to a comparative example is contemplated here in which a single resonator 111 is formed in a first substrate 110 as illustrated in FIG. 7. The resonator structure according to this comparative example establishes a resonance mode in which the resonator 111 resonates at a single resonance frequency f0 as illustrated in (A) of FIG. 9. Also, an example is contemplated here in which a second substrate 120, having a configuration similar to that of the resonator structure according to the comparative example illustrated in FIG. 7, is disposed to oppose the first substrate 110 while providing the inter-substrate distance Da in between so as to be electromagnetically coupled to the first substrate 110. A single resonator 121 is formed in the second substrate 120. Since the resonator 121 in the second substrate 120 is the same in structure as the resonator 111 in the first substrate 110, the sole resonance mode is established in which the resonator 121 resonates at the single resonance frequency f0 as illustrated in (A) of FIG. 9 in a sole state where the second substrate 120 is not electromagnetically coupled to the first substrate 110. On the other hand, in a state where the two resonators 111 and 121 illustrated in FIG. 8 are electromagnetically coupled to each other, the resonators 111 and 121 form a first resonance mode having the first resonance frequency f1 which is lower than the sole resonance frequency f0 and a second resonance mode having the second resonance frequency f2 which is higher than the sole resonance frequency f0 to resonate due to a propagation effect of an electric wave, rather than resonating at the sole resonance frequency f0.

When the two resonators 111 and 121 illustrated in FIG. 8, which are electromagnetically coupled to each other based on the hybrid resonance mode, are seen as a whole as a single coupled resonator 101, a resonator structure similar thereto may be arranged in a side-by-side fashion to structure a filter illustrated in FIG. 10 in which the first resonance frequency f1 (or the second resonance frequency f2) is a pass band. In the exemplary configuration of the filter illustrated in FIG. 10, two resonators 111 and 131 are arranged side-by-side in the first substrate 110, while two resonators 121 and 141 are arranged side-by-side in the second substrate 120. The resonators 111 and 131 formed in the first substrate 110 and the resonators 121 and 141 formed in the second substrate 120 each establish the resonance mode based on the sole resonance frequency f0 instead of establishing the hybrid resonance mode, when the first substrate 110 and the second substrate 120 are so sufficiently separated away from each other that they are not electromagnetically coupled to each other. In the state where the first substrate 110 and the second substrate 120 are disposed to oppose each other while providing the inter-substrate distance Da in between so as to be electromagnetically coupled to each other, the first resonator 111 in the first substrate 110 and the first resonator 121 in the second substrate 120 structure as a whole the single coupled resonator 101. Also, the second resonator 131 in the first substrate 110 and the second resonator 141 in the second substrate 120 structure as a whole another single coupled resonator 102. Each of the two coupled resonators 101 and 102 resonates as a whole at the first resonance frequency f1 (or the second resonance frequency f2), to thereby operate as a filter in which the first resonance frequency f1 (or the second resonance frequency f2) is the pass band. The signal transmission is possible by inputting a signal at a frequency near the first resonance frequency f1 (or the second resonance frequency f2).

In light of the principle discussed above, description will now be given in detail on a resonance mode in the signal transmission device according to the first embodiment. When the interdigitally-coupled resonators are formed on the substrates as illustrated in FIG. 5 such as the plurality of first quarter wavelength resonators 11 and 12; the plurality of second quarter wavelength resonators 21 and 22; the plurality of third quarter wavelength resonators 31 and 32; or the plurality of fourth quarter wavelength resonators 41 and 42, each of the interdigitally-coupled resonators resonates based on the hybrid resonance mode. For example, the first quarter wavelength resonators 11 and 12 are, electromagnetically coupled to each other based on the hybrid resonance mode to structure a single coupled resonator, which resonates at: the resonance frequency fa which is lower than the sole resonance frequency f0 derived from each of the first quarter wavelength resonators 11 and 12 alone in the state where the first quarter wavelength resonators 11 and 12 are each so sufficiently separated away from each other that they are not electromagnetically coupled to each other; and a resonance frequency fb which is higher than the resonance frequency f0. When the interdigitally-coupled plurality of first quarter wavelength resonators 11 and 12 formed in the first substrate 10 and the interdigitally-coupled plurality of second quarter wavelength resonators 21 and 22 formed in the second substrate 20 are electromagnetically coupled to one another through the element such as the air layer, those plurality of quarter wavelength resonators are also electromagnetically coupled based on the hybrid resonance mode as described above to establish the single coupled resonator (the first resonator 1) having a plurality of resonance modes. The first resonator 1 has the plurality of resonance modes, namely the resonance frequencies f1 and f2, etc., wherein the equation f1<f2<etc. is established. Likewise, when the interdigitally-coupled plurality of third quarter wavelength resonators 31 and 32 formed in the first substrate 10 and the interdigitally-coupled plurality of fourth quarter wavelength resonators 41 and 42 formed in the second substrate 20 are electromagnetically coupled to one another through the element such as the air layer, those plurality of quarter wavelength resonators are also electromagnetically coupled based on the hybrid resonance mode as described above to establish the single coupled resonator (the first resonator 2) having a plurality of resonance modes. The second resonator 2 has the plurality of resonance modes, namely the resonance frequencies f1 and f2, etc., wherein the equation f1<f2<etc. is established.

An electric potential distribution, an electric field vector E, and a current vector "i" in a resonance mode (the resonance frequency f1) having the lowest resonance frequency in the plurality of resonance modes are illustrated in FIG. 5, wherein currents flowing in the respective quarter wavelength resonators are all in the same direction. More specifically, the current flows from the short-circuit end to the open end in each of the quarter wavelength resonator 11 (or 31) and the quarter wavelength resonator 21 (or 41), whereas the current flows from the open end to the short-circuit end in each of the quarter wavelength resonator 12 (or 32) and the quarter wavelength resonator 22 (or 42). Thus, the electromagnetic coupling is established between the interdigitally-coupled resonators, while between the first substrate 10 and the second substrate 20, there is hardly any electric field distribution (an electric field component) between the quarter wavelength resonators which are located at the positions nearest to each other. In this way, in the resonance mode having the lowest resonance frequency in the plurality of resonance modes, the currents flowing in the respective quarter wavelength resonators 11 and 21, which are located at the positions nearest to each other between the first substrate 10 and the second substrate 20, are in the same direction and the electric field distribution hardly presents between those quarter wavelength resonators. Hence, the electromagnetic coupling based primarily on the magnetic field coupling is established therebetween.

Further, the interdigital coupling, due to its strong coupling, makes it possible to significantly increase a difference in frequency between the first resonance frequency f1 and the second resonance frequency f2. Thus, this allows the pass band including the first resonance frequency f1 and pass bands including other resonance frequencies in the plurality of resonance modes (the resonance frequencies f1 and f2, etc.) not to be overlapped one another (i.e., allows the frequencies of those pass bands to be different from one another) when the first resonator 1 and the second resonator 2 are arranged in a side-by-side fashion. Further, these pass band including the first resonance frequency f1 and the respective pass bands including other resonance frequencies (i.e., the respective pass bands including the respective frequencies of the plurality of resonance modes (the resonance frequencies f1 and f2, etc.)) are each not overlapped in frequency with the pass band including the resonance frequency fa derived from the first substrate 10 or the second substrate 20 alone (i.e., the frequencies of the pass bands are different from one another) as well. Thus, the pass band including the first resonance frequency f1 not only is less susceptible to other resonance modes but is also less susceptible to frequencies near the resonance frequency fa.

For the reasons discussed above, it is preferable that the resonance frequency f1 in the resonance mode, having the lowest frequency in the plurality of resonance modes, be set as a pass band of a signal. In an alternative embodiment, however, when the currents flowing in the respective quarter wavelength resonators, which are located at the positions nearest to each other between the first substrate 10 and the second substrate 20, are in the same direction even in other resonance mode higher in frequency than the resonance frequency f1, the resonance frequency of that resonance mode may be set as the pass band of a signal.

[Specific Design Example and Characteristics Thereof]

A specific design example of the signal transmission device according to the first embodiment and its characteristics will now be described in comparison to characteristics of a resonator structure according to a comparative example. FIG. 11 illustrates the specific design example of the resonator structure 201 according to the comparative example. FIG. 12 represents a resonance frequency characteristic of the resonator structure 201 illustrated in FIG. 11. In the resonator structure 201 according to the comparative example, the first quarter wavelength resonator 11 and the second quarter wavelength resonator 21 are not so disposed that respective open ends thereof are opposed to each other and respective short-circuit ends thereof are opposed to each other, and are interdigitally coupled to each other. Also, the front of the first substrate 10 and the back of the second substrate 20 are provided with a ground electrode 91 and a ground electrode 92 each serving as a ground layer, respectively. Each of the first substrate 10 and the second substrate 20 has a size as viewed from the top of two millimeters square, a substrate thickness of 100 micrometers, and a relative dielectric constant of 3.85. A size as viewed from the top of each electrode on the substrates (i.e., the first quarter wavelength resonators 11 and 12 and the second quarter wavelength resonators 21 and 22) has a length in the X-direction of 1.5 mm and a length in the Y-direction (i.e., a width) of 0.2 mm. FIG. 12 represents a result of calculation of a resonance frequency when a thickness of the air layer between the substrates (i.e., the inter-substrate distance Da) is varied from 10 micrometers to 100 micrometers in this configuration. As can be seen from FIG. 12, the resonance frequency varies up to about 70 percent with the variation in the thickness of the air layer in the resonator structure 201 according to the comparative example. One reason is that an effective relative dielectric constant varies between the first substrate 10 and the second substrate 20 due to the change in the thickness of the air layer.

FIG. 13 illustrates the specific design example of the first resonator 1 of the signal transmission device according to the first embodiment. FIG. 14 represents a resonance frequency characteristic of the design example illustrated in FIG. 13. In the design example of the first resonator 1, conditions such as the substrate size and the electrode size are same as those of the resonator structure 201 according to the comparative example illustrated in FIG. 11. In other words, the design example has a configuration similar to that of the resonator structure 201 according to the comparative example illustrated in FIG. 11, except that the first quarter wavelength resonator 11 and the second quarter wavelength resonator 21 are so disposed that, instead of being interdigitally coupled to each other, the respective open ends thereof are opposed to each other and the respective short-circuit ends thereof are opposed to each other. FIG. 14 represents a result of calculation of a resonance frequency when the thickness of the air layer between the substrates (i.e., the inter-substrate distance Da) is varied from 10 micrometers to 100 micrometers in this configuration. In the resonator structure according to the first embodiment, as can be seen from FIG. 14, a change in the resonance frequency is small, and the resonance frequency varies only up to about 4 percent with the variation in the thickness of the air layer. It is to be noted that, in the characteristic graph of FIG. 14, a value of the resonance frequency fluctuates up and down with the variation in the inter-substrate distance Da, as if the graph is a polygonal line graph. This is due to an error in calculation, and in fact the resonance frequency increases gradually with the increase in the inter-substrate distance Da to form a gently curved graph.

FIGS. 15A and 15B and FIGS. 16A and 16B each illustrate a specific design example of the signal transmission device as a whole according to the first embodiment (a design example as a filter). FIG. 15A illustrates a specific design example of the resonator structure in the front of the first substrate 10, and FIG. 15B illustrates a specific design example of the resonator structure in the back of the first substrate 10 (a side of the first substrate 10 opposing the second substrate 20). FIG. 16A illustrates a specific design example of the resonator structure in the front of the second substrate 20 (a side of the second substrate 20 opposing the first substrate 10), and FIG. 16B illustrates a specific design example of the resonator structure in the back of the second substrate 20. FIG. 17 represents a result of calculation of a resonance frequency when the thickness of the air layer between the substrates (i.e., the inter-substrate distance Da) is varied from 20 micrometers to 600 micrometers in this configuration, and indicates a pass characteristic and a reflection characteristic as a filter. It can be seen from FIG. 17 that the pass characteristic as the filter is hardly influenced by the variation in the inter-substrate distance Da.

FIG. 18 describes an electric field distribution between the first substrate 10 and the second substrate 20 according to the design example illustrated in FIG. 15A to FIG. 16B. FIG. 19 describes a magnetic field distribution between the first substrate 10 and the second substrate 20 according to the design example. As can be seen from FIGS. 18 and 19, there is hardly any electric field between the first substrate 10 and the second substrate 20, and only a magnetic field is formed therebetween. In other words, there is hardly any electric field component between the first substrate 10 and the second substrate 20, and a magnetic field component serves as a primary component therebetween. It is to be noted that FIG. 17 represents frequency characteristics based on the first resonance mode in the hybrid resonance mode described above, and FIG. 18 represents the electric field distribution based on the first resonance mode in the hybrid resonance mode. FIG. 19 represents the magnetic field distribution based on the first resonance mode in the hybrid resonance mode,

[Effect]

According to the signal transmission device of the first embodiment, the quarter wavelength resonators, which are located at positions nearest to each other between the first substrate 10 and the second substrate 20, are mutually coupled through the electromagnetic coupling which primarily involves the magnetic field component. Thus, in each of the first resonator 1 and the second resonator 2, there is hardly any electric field distribution (the electric field component) in an element such as, but not limited to, the air layer between the first substrate 10 and the second substrate 20. This makes it possible to suppress the variation in the resonance frequency in each of the first resonator 1 and the second resonator 2 even when the variation is occurred in the inter-substrate distance Da of the element such as, but not limited to, the air layer between the first substrate 10 and the second substrate 20. Hence, it is possible to suppress the variation in factors such as the pass frequency and the pass band caused by the variation in the inter-substrate distance Da.

Incidentally, there are methods to increase a Q-value of a resonator, which are as follows:

1. To reduce a loss in the resonator; and
2. To increase the volume of the resonator.

In the resonator structure of the signal transmission device according to the first embodiment, the interdigital resonator is used at least in the first substrate 10 to reduce the loss in the resonator, as for the method "to reduce a loss in the resonator". On the other hand, the method "to increase the volume of the resonator" act counter to miniaturization of component parts. For example, when assuming that the first substrate 10 is a component part of a resonator structure and the second substrate 20 is a mounting substrate for mounting the component part of the resonator structure, the volume of the component part is increased in order to increase the Q-value of the resonator in a currently-available resonator structure. In contrast, in the resonator structure according to the first embodiment, an electrode pattern on the mounting substrate (such as the second quarter wavelength resonator 21) is used as a part of the resonator. Thus, the resonator structure according to the first embodiment makes it possible to increase the Q-value of the resonator without increasing the volume of the component parts, by utilizing the volume of the mounting substrate as a part of the resonator. Further, in the resonator structure according to the first embodiment, the electrode pattern on the mounting substrate has the configuration of the interdigital resonator such as that established by the second quarter wavelength resonators 21 and 22, by which a further reduction of the loss is realized. Moreover, in the resonator structure according to the first embodiment, the component part (the first substrate 10) is coupled to the mounting substrate (the second substrate 20) through the electromagnetic coupling without, for example, providing a terminal on a side surface of the component part (the first substrate 10), making it possible to achieve the simplified configuration and cost reduction.

[Second Embodiment]

Hereinafter, a signal transmission device according to a second embodiment of the technology will be described. Note that the same or equivalent elements as those of the signal transmission device according to the first embodiment described above are denoted with the same reference numerals, and will not be described in detail.

FIG. 20 illustrates a cross-sectional configuration of the signal transmission device according to the second embodiment of the technology. The first resonator 1 illustrated in FIGS. 1 and 2 according to the first embodiment has the configuration in which the first substrate 10 and the second substrate 20 are each formed with the two quarter wavelength resonators. In the second embodiment, a first resonator 1A illustrated in FIG. 20 may have a configuration in which the second substrate 20 may be provided only with the single second quarter wavelength resonator 21 electromagnetically coupled (mainly magnetically coupled) to the first quarter wavelength resonator 11 provided on the first substrate 10. Also, although unillustrated, the second resonator 2 may likewise have a configuration in which the second substrate 20 may be provided only with the single fourth quarter wavelength resonator 41 electromagnetically coupled (mainly magnetically coupled) to the third quarter wavelength resonator 31 provided on the first substrate 10. According to the second embodiment, likewise, in the resonance mode having the lowest resonance frequency f1 in the plurality of resonance modes, the currents flowing in the respective quarter wavelength resonators 11 and 21, which are located at the positions nearest to each other between the first substrate 10 and the second substrate 20, are in the same direction, and the electric field distribution hardly presents between the quarter wavelength resonators.

[Third Embodiment]

Hereinafter, a signal transmission device according to a third embodiment of the technology will be described. Note that the same or equivalent elements as those of the signal transmission device according to the first or the second embodiment described above are denoted with the same reference numerals, and will not be described in detail.

FIG. 21 illustrates a cross-sectional configuration of the signal transmission device according to the third embodiment of the technology. In the first resonator 1 illustrated in FIGS. 1 and 2 according to the first embodiment, the two substrates, namely the first substrate 10 and the second substrates 20 form the first resonator 1, although a configuration may be employed where three or more substrates are disposed in an opposed fashion. FIG. 21 illustrates the third embodiment in which, in addition to the first substrate 10 and the second substrate 20, a third substrate 30 is disposed in an opposed fashion to structure a first resonator 1B. The third substrate 30 is so disposed to oppose the back of the second substrate, with the spacing in between (i.e., the inter-substrate distance Da), as to sandwich the layer made of the material different from the substrate material (such as a layer having a dielectric constant different from that of the substrate material, such as, but not limited to, the air layer). The front of the third substrate 30 (a side of the third substrate 30 opposing the second substrate 20) is formed with a quarter wavelength resonator 61, and the back of the third substrate 30 is formed with a quarter wavelength resonator 62. The quarter wavelength resonators 61 and 62 are interdigitally coupled to each other in the first direction (the Z-direction in the drawing) in a region corresponding to the first region in which the first quarter wavelength resonators 11 and 12 and the second quarter wavelength resonators 21 and 22 are formed. Also, the second quarter wavelength resonator 22 and the quarter wavelength resonator 61, which are located at positions nearest to each other between the second substrate 20 and the third substrate 30, are so disposed that respective open ends thereof are opposed to each other and respective short-circuit ends thereof are opposed to each other. Thereby, the second quarter wavelength resonator 22 in the second substrate 20 and the quarter wavelength resonator 61 in the third substrate 30 are coupled, such as via the air layer, to each other through the electromagnetic coupling which primarily involves the magnetic field component. According to the third embodiment, likewise, in the resonance mode having the lowest resonance frequency f1 in the plurality of resonance modes, the currents flowing in the respective quarter wavelength resonators 11 and 21 (or the quarter wavelength resonators 22 and 61), which are located at the positions nearest to each other between the first substrate 10 and the second substrate 20 (or between the second substrate 20 and the third substrate 30), are in the same direction, and the electric field distribution hardly presents between the quarter wavelength resonators.

Also, although unillustrated, the second resonator 2 may likewise have a configuration in which the third substrate 30 formed with the quarter wavelength resonators is added as a component element.

[Fourth Embodiment]

Hereinafter, a signal transmission device according to a fourth embodiment of the technology will be described. Note that the same or equivalent elements as those of the signal transmission devices according to the first to the third embodiments described above are denoted with the same reference numerals, and will not be described in detail.

FIG. 22 illustrates a cross-sectional configuration of the signal transmission device according to the fourth embodiment of the technology. In the signal transmission device illustrated in FIG. 1 according to the first embodiment, the first signal-lead electrode 51 is directly connected physically to the first quarter wavelength resonator 12 formed on the first substrate 10 so as to be in conduction directly with the first quarter wavelength resonator 12. In the fourth embodiment, a first signal-lead electrode 53 may be provided which is so disposed as to have a spacing relative to each of the first quarter wavelength resonators 11 and 12 of the first resonator 1, as illustrated in FIG. 22. The first signal-lead electrode 53 here is structured by a resonator which resonates at the similar resonance frequency f1 as the resonance frequency f1 of the first resonator 1, by which the first signal-lead electrode 53 and the first resonator 1 are electromagnetically coupled at the resonance frequency f1.

Likewise, although the second signal-lead electrode 52 is directly connected physically to the fourth quarter wavelength resonator 42 formed on the second substrate 20 so as to be in conduction directly with the fourth quarter wavelength resonator 42 in the signal transmission device illustrated in FIG. 1 according to the first embodiment, a second signal-lead electrode 54 may be provided which is so disposed as to have a spacing relative to each of the fourth quarter wavelength resonators 41 and 42 of the second resonator 2, as illustrated in FIG. 22. The second signal-lead electrode 54 here is structured by a resonator which resonates at the similar resonance frequency f1 as the resonance frequency f1 of the second resonator 2, by which the second signal-lead electrode 54 and the second resonator 2 are electromagnetically coupled at the resonance frequency f1.

[Fifth Embodiment]

Hereinafter, a signal transmission device according to a fifth embodiment of the technology will be described. Note that the same or equivalent elements as those of the signal transmission devices according to the first to the fourth embodiments described above are denoted with the same reference numerals, and will not be described in detail.

FIG. 23 illustrates a cross-sectional configuration of the signal transmission device according to the fifth embodiment of the technology. In the signal transmission device illustrated in FIG. 1 according to the first embodiment, each of the quarter wavelength resonators structuring the first resonator 1 is formed on the front and/or the back of the first substrate 10 and the second substrate 20. In the fifth embodiment, a first resonator 1C illustrated in FIG. 23 may have a configuration in which each of the quarter wavelength resonators are formed inside of the first substrate 10 and the second substrate 20. The second resonator 2 may likewise have a configuration in which each of the quarter wavelength resonators are formed inside of the first substrate 10 and the second substrate 20.

[Sixth Embodiment]

Hereinafter, a signal transmission device according to a sixth embodiment of the technology will be described. Note that the same or equivalent elements as those of the signal transmission devices according to the first to the fifth embodiment described above are denoted with the same reference numerals, and will not be described in detail.

FIG. 24 illustrates a cross-sectional configuration of the signal transmission device according to the sixth embodiment of the technology. The first resonator 1C illustrated in FIG. 23 according to the fifth embodiment has the configuration in which the first substrate 10 and the second substrate 20 are each formed therein with the two quarter wavelength resonators, although the number of quarter wavelength resonators to be formed in each of the first substrate 10 and the second substrate 20 may be three or more. FIG. 24 illustrates the sixth embodiment where four first quarter wavelength resonators 11, 12, 13, and 14 are formed inside the first substrate 10. Each of the four first quarter wavelength resonators 11, 12, 13, and 14 is so disposed that the mutually-adjacent quarter wavelength resonators thereof are interdigitally coupled to one another in the first direction. Similarly, in the second resonator 2, the number of quarter wavelength resonators to be formed in each of the first substrate 10 and the second substrate 20 may be three or more. According to the sixth embodiment, likewise, in the resonance mode having the lowest resonance frequency f1 in the plurality of resonance modes, the currents flowing in the respective quarter wavelength resonators 11 and 21, which are located at the positions nearest to each other between the first substrate 10 and the second substrate 20, are in the same direction, and the electric field distribution hardly presents between the quarter wavelength resonators.

Also, although unillustrated, only the single second quarter wavelength resonator 21 may be provided inside the second substrate 20 as in the configuration of the first resonator IA illustrated in FIG. 20. Likewise, the second resonator 2 may be provided, inside the second substrate 20, with the single four quarter wavelength resonator 41 only.

[Seventh Embodiment]

Hereinafter, a signal transmission device according to a seventh embodiment of the technology will be described.

Note that the same or equivalent elements as those of the signal transmission devices according to the first to the sixth embodiment described above are denoted with the same reference numerals, and will not be described in detail.

FIG. 25 illustrates an example of an overall configuration of the signal transmission device (or a filter) according to the seventh embodiment of the technology. FIG. 26 illustrates a cross-sectional configuration as viewed from the X-direction of the signal transmission device illustrated in FIG. 25. FIG. 27A illustrates a resonator structure of a first layer and a third layer from the bottom of the first substrate 10 (a side of the first substrate 10 opposing the second substrate 20) in the signal transmission device illustrated in FIG. 25, and FIG. 27B illustrates a resonator structure of a second layer and a fourth layer from the bottom of the first substrate 10. FIG. 28 illustrates a resonator structure on the front of the second substrate 20 (a side of the second substrate 20 opposing the first substrate 10) in the signal transmission device illustrated in FIG. 25.

The signal transmission device according to the seventh embodiment has a configuration in which: the first substrate 10 serves as a component part (a mounting component part) of a resonator structure; and the second substrate 20 serves as a mounting substrate for mounting the component part of the resonator structure. As in the configuration example illustrated in FIG. 24, each of the first quarter wavelength resonators 11, 12, 13, and 14 is so disposed inside the first substrate 10 that the mutually-adjacent first quarter wavelength resonators are interdigitally coupled to one another in the first direction. Also, the plurality of third quarter wavelength resonators 31, 32, 33, and 34 are arranged inside the first substrate 10 in a side-by-side fashion relative to the plurality of first quarter wavelength resonators 11, 12, 13, and 14, as illustrated in FIGS. 27A and 27B. Each of the third quarter wavelength resonators 31, 32, 33, and 34 is also so disposed that the mutually-adjacent third quarter wavelength resonators are interdigitally coupled to one another in the first direction. The first substrate 10 is further formed with ground electrodes 73 and 74 extending in a first side direction (in the Y-direction in the drawings). The plurality of first quarter wavelength resonators 11, 12, 13, and 14 and the plurality of third quarter wavelength resonators 31, 32, 33, and 34 each have a short-circuit end which is in conduction with the ground electrode 73 or 74. It is to be noted that a thickness of each of the electrode patterns (such as the first quarter wavelength resonators 11 and 12) formed in the first substrate 10 and the second substrate 20 is omitted in FIG. 25.

The bottom of the second substrate 20 is formed with a ground electrode 77 as illustrated in FIG. 26. As illustrated in FIG. 28, the top of the second substrate 20 is formed with electrode patterns which are equivalent to the second quarter wavelength resonator 21 and the fourth quarter wavelength resonator 41. The second quarter wavelength resonator 21 is provided in a first region corresponding to the plurality of first quarter wavelength resonators 11, 12, 13, and 14. The first quarter wavelength resonator 11 and the second quarter wavelength resonator 21 are coupled, with a spacing (the inter-substrate distance Da) arising from an element such as the air layer in between, to each other through the electromagnetic coupling which primarily involves the magnetic field component. Thereby, a first resonator 1E is formed having a configuration in which the plurality of first quarter wavelength resonators 11, 12, 13, and 14 and the single second quarter wavelength resonator 21 are disposed and stacked in the first direction. The fourth quarter wavelength resonator 41 is provided in a second region corresponding to the plurality of third quarter wavelength resonators 31, 32, 33, and 34. The third quarter wavelength resonator 31 and the fourth quarter wavelength resonator 41 are coupled, with a spacing (the inter-substrate distance Da) arising from an element such as the air layer in between, to each other through the electromagnetic coupling which primarily involves the magnetic field component. Thereby, a second resonator 2E is formed having a configuration in which the plurality of third quarter wavelength resonators 31, 32, 33, and 34 and the single fourth quarter wavelength resonator 41 are disposed and stacked in the first direction. According to the seventh embodiment, likewise, in the resonance mode having the lowest resonance frequency f1 in the plurality of resonance modes, the currents flowing in the respective quarter wavelength resonators 31 and 41, which are located at the positions nearest to each other between the first substrate 10 and the second substrate 20, are in the same direction, and the electric field distribution hardly presents between the quarter wavelength resonators.

The top of the second substrate 20 is formed, in the first side direction (in the Y-direction in the drawings), with electrode patterns which are equivalent to ground electrodes 75 and 76. As illustrated in FIG. 28, the second quarter wavelength resonator 21 has a short-circuit end which is in conduction with the ground electrode 76. The fourth quarter wavelength resonator 41 has a short-circuit end which is in conduction with the ground electrode 75.

The second quarter wavelength resonator 21 has an open end to which a first end of a first signal-lead electrode 71 is directly connected physically. Thus, the second quarter wavelength resonator 21 and the first signal-lead electrode 71 are mutually in direct conduction, thereby allowing a signal transmission to be established between the first signal-lead electrode 71 and the first resonator 1E. The fourth quarter wavelength resonator 41 has an open end to which a first end of a second signal-lead electrode 72 is directly connected physically. Thus, the fourth quarter wavelength resonator 41 and the second signal-lead electrode 72 are mutually in direct conduction. A second end of the first signal-lead electrode 71 and a second end of the second signal-lead electrode 72 extend in opposite directions to each other in a second side direction (in the X-direction in the drawings). The first resonator 1E and the second resonator 2E are electromagnetically coupled to each other, thereby allowing a signal transmission to be established between the first signal-lead electrode 71 and the second signal-lead electrode 72 from one side to the other. In other words, the signal transmission within the second substrate 20 is possible in the signal transmission device according to the seventh embodiment.

As illustrated in FIG. 27A, an open end of the first quarter wavelength resonator 11 (or the first quarter wavelength resonator 13) is formed with a wide electrode part 11A. Likewise, an open end of the first quarter wavelength resonator 12 (or the first quarter wavelength resonator 14) is formed with a wide electrode part 12A, as illustrated in FIG. 27B. As illustrated in FIG. 27A, an open end of the third quarter wavelength resonator 31 (or the third quarter wavelength resonator 33) is formed with a wide electrode part 31A. Likewise, an open end of the third quarter wavelength resonator 32 (or the third quarter wavelength resonator 34) is formed with a wide electrode part 32A, as illustrated in FIG. 27B. Thus, for example, the wide electrode part 11A of the first quarter wavelength resonator 11 and the wide electrode part 32A of the third quarter wavelength resonator 32 are opposed to each other between the top and bottom electrode layers, thereby making it possible to obtain the electromagnetic coupling having a desired degree of coupling between the plurality of first quarter wavelength resonators 11, 12, 13, and 14 and the plurality of third quarter wavelength resonators 31, 32, 33, and 34 (between the first resonator 1E and the second resonator 2E), while preventing an increase in a length of the electrode patterns.

According to the signal transmission device of the seventh embodiment, the electrode pattern (such as the second quarter wavelength resonator 21) on the second substrate 20 serving as the mounting substrate is used as a part of the resonator, and the electrode pattern on the second substrate 20 operates and resonates together with the resonator structure of the first substrate 10 serving as the mounting component part. This makes it possible to utilize the volume in a vertical direction to transmit a signal. Hence, as compared with a case where only the electrode patterns on the second substrate 20 are used to perform the transmission, it is possible to prevent an increase in the area in a plane direction in a case where a particular frequency is selected as a filter to transmit a signal. Namely, it is possible to perform, as a filter, the signal transmission within the substrate while preventing the increase in the area in the plane direction.

[Other Embodiments]

Although the technology has been described in the foregoing by way of example with reference to the embodiments, the technology is not limited thereto but may be modified in a wide variety of ways.

For example, in the first embodiment described above, the first resonator 1 and the second resonator 2 both have substantially the same resonator structure as illustrated in FIG. 2, although it is not limited thereto. Alternatively, for example, the second resonator 2 may have a different resonator structure, as long as the configuration is established in which currents flowing in respective resonators, which are located at positions nearest to each other between the mutually-different substrates, are in the same direction.

Also, in the first embodiment described above, the two resonators, namely the first resonator and the second resonator, are disposed in a side-by-side fashion, although it is not limited thereto. Alternatively, three or more resonators may be arranged in a side-by-side fashion.

Further, in the first embodiment described above, the dielectric substrates are formed with the $\lambda/4$ wavelength resonators, although it is not limited thereto. Alternatively, other resonators such as a $\lambda/2$ wavelength resonator, a $3\lambda/4$ wavelength resonator, and a $\lambda$ wavelength resonator may be employed, as long as the resonator is a line resonator in which a resonance frequency of the resonator alone is f0.

In the first embodiment described above, the relative dielectric constant of the first substrate 10 and that of the second substrate 20 are made equal to each other, although it is not limited thereto. Alternatively, the relative dielectric constant of the first substrate 10 and that of the second substrate 20 may be different from each other, as long as a layer having a relative dielectric constant different from that of at least one of the first substrate 10 and the second substrate 20 is sandwiched therebetween.

In the first embodiment described above, the first substrate 10 and/or the second substrate 20 is formed only with the interdigitally-coupled resonators, although it is not limited thereto. The resonators may be so formed that some of the resonators are coupled through a comb-line coupling, as long as the substrate is formed with at least a pair of interdigitally-coupled resonators.

These alternative embodiments are also applicable to other embodiments such as the second to the seventh embodiments described above.

As used herein, the term "signal transmission device" refers not only to a signal transmission device for transmitting and receiving a signal such as an analog signal and a digital signal, but also refers to a signal transmission device used for transmitting and receiving electric power.

The present disclosure contains subject matter related to that disclosed in Japanese Priority Patent Application JP 2010-194556 filed in the Japan Patent Office on Aug. 31, 2010, the entire content of which is hereby incorporated by reference.

Although the technology has been described in terms of exemplary embodiments, it is not limited thereto. It should be appreciated that variations may be made in the described embodiments by persons skilled in the art without departing from the scope of the technology as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. Moreover, no element or component in this disclosure is intended to be dedicated to the public regardless of whether the element or component is explicitly recited in the following claims.

What is claimed is:

1. A signal transmission device, comprising:

a first substrate and a second substrate which are disposed to oppose each other in a first direction with a spacing in between;

a first resonator including a plurality of first quarter wavelength resonators and a single or a plurality of second quarter wavelength resonators, the plurality of first quarter wavelength resonators being provided in a first region of the first substrate, each of the plurality of first quarter wavelength resonators extending in a second direction between two opposite sides thereof, and interdigitally coupled to one another in the first direction, the single or the plurality of second quarter wavelength resonators being provided in a region of the second substrate corresponding to the first region and each of the single or the plurality of second quarter wavelength resonators extending in the second direction between two opposite sides thereof, and the plurality of second quarter wavelength resonators being interdigitally coupled to one another in the first direction; and a second resonator electromagnetically coupled to the first resonator, and performing a signal transmission between the second resonator and the first resonator, wherein one first quarter wavelength resonator of the plurality of first quarter wavelength resonators has a first short-circuit end and has a first open end on the opposite side as the first short-circuit end in the second direction, one second quarter wavelength resonator of the single or the plurality of second quarter wavelength resonators has a second short-circuit end on the same side as the first short-circuit end in the second direction, and has a second open end on the same side as the first open end in the second direction, such that the one first quarter wavelength resonator and the one second quarter wavelength resonator, are located at positions nearest to one another among plurality of pairs consisting of one of the plurality of first quarter wavelength resonators and one of the single or the plurality of second quarter wavelength resonators, and the first open end and the second open end are disposed to oppose one another in the first direction, and the first short-circuit end and the second short-circuit end are disposed to oppose one another in the first direction.

2. The signal transmission device according to claim 1, wherein the second resonator includes a plurality of third quarter wavelength resonators and a single or a plurality of fourth quarter wavelength resonators, the plurality of third quarter wavelength resonators being provided in a second region of the first substrate, each of the plurality of third quarter wavelength resonators extending in the second direction between two opposite sides thereof, and interdigitally coupled to one another in the first direction, the single or the plurality of fourth quarter wavelength resonators being provided in a region of the second substrate corresponding to the second region and each of the single or the plurality of fourth quarter wavelength resonators extending in the second direction between two opposite sides thereof, and the plurality of fourth quarter wavelength resonators being interdigitally coupled to one another in the first direction, one third quarter wavelength resonator of the plurality of third quarter wavelength resonators has a third short-circuit end, and has a third open end on the opposite side as the third short-circuit end in the second direction, one fourth quarter wavelength resonator of the single or the plurality of fourth quarter wavelength resonators has a fourth short-circuit end on the same side as the third short-circuit end in the second direction, and has a fourth open end on the same side as the third open end in the second direction, such that the one third quarter wavelength resonator and the one fourth quarter wavelength resonator are located at positions nearest to one another among plurality of pairs consisting of one of the plurality of third quarter wavelength resonators and one of the single or the plurality of fourth quarter wavelength resonators, and the third open end and the fourth open end are disposed to oppose one another in the first direction, and the third short-circuit end and the fourth short-circuit end are disposed to oppose one another in the first direction.

3. The signal transmission device according to claim 2, further comprising:

a first signal-lead electrode provided in the first substrate, the first signal-lead electrode being directly connected physically to one of the plurality of first quarter wavelength resonators, or being electromagnetically coupled to one of the plurality of first quarter wavelength resonators while providing a spacing in between; and a second signal-lead electrode provided in the second substrate, the second signal-lead electrode being directly connected physically to the single fourth quarter wavelength resonator or to one of the plurality of fourth quarter wavelength resonators, or being electromagnetically coupled to the single fourth quarter wavelength resonator or to one of the plurality of fourth quarter wavelength resonators while providing a spacing in between, wherein the signal transmission is performed between the first substrate and the second substrate.

4. The signal transmission device according to claim 2, further comprising:

a first signal-lead electrode provided in the second substrate, the first signal-lead electrode being directly connected physically to the single second quarter wavelength resonator or to one of the plurality of second quarter wavelength resonators, or being electromagnetically coupled to the single second quarter wavelength resonator or to one of the plurality of second quarter wavelength resonators while providing a spacing between the first signal-lead electrode and the first resonator; and a second signal-lead electrode provided in the second substrate, the second signal-lead electrode being directly connected physically to the single fourth quarter wavelength resonator or to one of the plurality of fourth quarter wavelength resonators, or being electromagnetically coupled to the single fourth quarter wavelength resonator or to one of the plurality of fourth quarter wavelength resonators while providing a spacing between the second signal-lead electrode and the second resonator, wherein the signal transmission is performed within the second substrate.

5. The signal transmission device according to claim 2, wherein, in the first resonator, the plurality of first quarter wavelength resonators and the single or the plurality of second quarter wavelength resonators are electromagnetically coupled based on a hybrid resonance mode to allow the first resonator to structure a single coupled resonator resonating at a first resonance frequency as a whole, and, when the first and the second substrates are separated away from each other to fail to be electromagnetically coupled to one another, a resonance frequency derived from the plurality of first quarter wavelength resonators alone and a resonance frequency derived from the single or the plurality of second quarter wavelength resonators alone are each a frequency different from the first resonance frequency, and wherein, in the second resonator, the plurality of third quarter wavelength resonators and the single or the plurality of fourth quarter wavelength resonators are electromagnetically coupled based on the hybrid resonance mode to allow the second resonator to structure a single coupled resonator resonating at the first resonance frequency as a whole, and, when the first and the second substrates are separated away from each other to fail to be electromagnetically coupled to one another, a resonance frequency derived from the plurality of third quarter wavelength resonators alone and a resonance frequency derived from the single or the plurality of fourth quarter wavelength resonators alone are each the frequency different from the first resonance frequency.

6. A filter, comprising:

a first substrate and a second substrate which are disposed to oppose each other in a first direction with a spacing in between;

a first resonator including a plurality of first quarter wavelength resonators and a single or a plurality of second quarter wavelength resonators, the plurality of first quarter wavelength resonators being provided in a first region of the first substrate, each of the plurality of first quarter wavelength resonators extending in a second direction between two opposite sides thereof, and interdigitally coupled to one another in the first direction, the single or the plurality of second quarter wavelength resonators being provided in a region of the second substrate corresponding to the first region and each of the single or the plurality of second quarter wavelength resonators extending in the second direction between two opposite sides thereof, and the plurality of second quarter wavelength resonators being interdigitally coupled to one another in the first direction; and a second resonator electromagnetically coupled to the first resonator, and performing a signal transmission between the second resonator and the first resonator, wherein one first quarter wavelength resonator of the plurality of first quarter wavelength resonators has a first short-circuit end, and has a first open end on the opposite side as the first short-circuit end in the second direction, one second quarter wavelength resonator of the single or the plurality of second quarter wavelength resonators has a second short-circuit end on the same side as the first short-circuit end in the second direction, and has a second open end on the same side as the first o en end in the second direction, such that the one first quarter wavelength resonator and the one second quarter wavelength resonator are located at positions nearest to one another among plurality of pairs consisting of one of the plurality of first quarter wavelength resonators and one of the single or the plurality of second quarter wavelength resonators, and the first open end and the second open end are disposed to oppose one another in the first direction, and the first short-circuit end and the second short-circuit end are disposed to oppose one another in the first direction.

7. An inter-substrate communication device, comprising:

a first substrate and a second substrate which are disposed to oppose each other in a first direction with a spacing in between;

a first resonator including a plurality of first quarter wavelength resonators and a single or a plurality of second quarter wavelength resonators, the plurality of first quarter wavelength resonators being provided in a first region of the first substrate, each of the plurality of first quarter wavelength resonators extending in a second direction between two opposite sides thereof, and interdigitally coupled to one another in the first direction, the single or the plurality of second quarter wavelength resonators being provided in a region of the second substrate corresponding to the first region and each of the single or the plurality of second quarter wavelength resonators extending in the second direction between two opposite sides thereof, and the plurality of second quarter wavelength resonators being interdigitally coupled to one another in the first direction;

the second resonator including a plurality of third quarter wavelength resonators and a single or a plurality of fourth quarter wavelength resonators, the plurality of third quarter wavelength resonators being provided in a second region of the first substrate, each of the plurality of third quarter wavelength resonators extending in the second direction between two opposite sides thereof, and interdigitally coupled to one another in the first direction, the single or the plurality of fourth quarter wavelength resonators being provided in a region of the second substrate corresponding to the second region and each of the single or the plurality of fourth quarter wavelength resonators extending in the second direction between two opposite sides thereof, and the plurality of fourth quarter wavelength resonators being interdigitally coupled to one another in the first direction, and the second resonator being electromagnetically coupled with the first resonator and performing a signal transmission between the second resonator and the first resonator;

a first signal-lead electrode provided in the first substrate, the first signal-lead electrode being directly connected physically to one of the plurality of first quarter wavelength resonators, or being electromagnetically coupled to one of the plurality of first quarter wavelength resonators while providing a spacing in between; and a second signal-lead electrode provided in the second substrate, the second signal-lead electrode being directly connected physically to the single fourth quarter wavelength resonator or to one of the plurality of fourth quarter wavelength resonators, or being electromagnetically coupled to the single fourth quarter wavelength resonator or to one of the plurality of fourth quarter wavelength resonators while providing a spacing in between, wherein one first quarter wavelength resonator of the plurality of first quarter wavelength resonators has a first short-circuit end, and has a first open end on the opposite side as the first short-circuit end in the second direction, one second quarter wavelength resonator of the single or the plurality of second quarter wavelength resonators has a second short-circuit end on the same side as the first short-circuit end in the second direction, and has a second open end on the same side as the first open end in the second direction, such that the one first quarter wavelength resonator and the one second quarter wavelength resonator are located at positions nearest to one another among plurality of pairs consisting of one of the plurality of first quarter wavelength resonators and one of the single or the plurality of second quarter wavelength resonators, one third quarter wavelength resonator of the plurality of third quarter wavelength resonators has a third short-circuit end, and has a third open end on the opposite side as the third short-circuit end in the second direction, one fourth quarter wavelength resonator of the single or the plurality of fourth quarter wavelength resonators has a fourth short-circuit end on the same side as the third short-circuit end in the second direction, and has a fourth open end on the same side as the third open end in the second direction, such that the one third quarter wavelength resonator and the one fourth quarter wavelength resonator are located at positions nearest to one another among plurality of pairs consisting of one of the plurality of third quarter wavelength resonators and one of the single or the plurality of fourth quarter wavelength resonators, the first open end and the second open end are disposed to oppose one another in the first direction, and the first short-circuit end and the second short-circuit end are disposed to oppose one another in the first direction, the third open end and the fourth open end are disposed to oppose one another in the first direction, and the third short-circuit end and the fourth short-circuit end being disposed to oppose one another in the first direction, and the signal transmission is performed between the first substrate and the second substrate.

* * * * *